United States Patent [19]

Swisher, Jr. et al.

[11] 4,325,580

[45] Apr. 20, 1982

[54] ROADWAY PLANING APPARATUS

[75] Inventors: George W. Swisher, Jr., Oklahoma City; Donald W. Smith, Edmond; Carl D. Parker, Yukon, all of Okla.

[73] Assignee: CMI Corporation, Oklahoma City, Okla.

[21] Appl. No.: 36,447

[22] Filed: May 7, 1979

[51] Int. Cl.[3] ..... E01C 23/09

[52] U.S. Cl. ..... 299/39; 37/108 R; 404/90

[58] Field of Search ..... 299/39, 81; 404/90; 173/60, 61; 175/17; 37/108 R

[56] References Cited

U.S. PATENT DOCUMENTS

| | | | |
|---|---|---|---|
| 3,055,647 | 9/1962 | Morrison et al. | 175/17 X |
| 3,423,859 | 1/1969 | Swisher et al. | 37/108 R |
| 3,802,525 | 4/1974 | Snow et al. | 37/108 R |
| 3,895,843 | 7/1975 | Wall et al. | 299/39 |
| 3,923,341 | 12/1975 | Miller | 299/39 X |
| 3,946,506 | 3/1976 | Snow et al. | 37/108 R |
| 4,041,623 | 8/1977 | Miller et al. | 299/39 X |
| 4,171,147 | 10/1979 | Swisher et al. | 404/90 X |

FOREIGN PATENT DOCUMENTS

| | | | |
|---|---|---|---|
| 2713460 | 10/1977 | Fed. Rep. of Germany | 404/90 |

OTHER PUBLICATIONS

PR-225 Pavement Profiler Parts Book, Issue No. 3, CMI Corporation, Aug. 1, 1978.

PR-225 Pavement Profiler Maintenance Manual, Issue No. 2, CMI Corporation, Jun. 1978.

*Primary Examiner*—Ernest R. Purser

*Attorney, Agent, or Firm*—Dunlap & Codding

[57] ABSTRACT

A planer apparatus for cutting a selected upper portion of a roadway surface to coincide with a preselected reference plane, comprising a main frame drivingly supported by a drive assembly, the main frame carrying a planing assembly comprising a rotating cutter drum assembly and a cutter drive assembly. The cutter drive assembly comprises a pair of cutter power assemblies which are disposed on one side of the main frame and which are connected to a rotating hub member. The rotating hub member is carried by load-bearing hub support surfaces, with the rotating hub member rotatably driving the cutter drum assembly.

The planer apparatus further comprises an upper material lifting conveyor for elevating and moving roadway material disengaged from the roadway by the planing assembly. The upper material lifting conveyor features an upper conveyor cover connecting the side members of the upper conveyor frame, with the conveyor motor assembly mounted on the upper conveyor frame between the side members. A spray bar assembly cleans the non-transport surface of the conveyor belt of the upper material lifting conveyor.

The planer apparatus may be powered either by a main or auxiliary drive unit, with the exhaust discharge system of the main drive unit disposed in heat-transferring relationship to a water spray system providing dust control for the apparatus.

33 Claims, 11 Drawing Figures

ROADWAY PLANING APPARATUS

BACKGROUND OF THE INVENTION

1. Field of the Invention

The present invention relates generally to the field of construction apparatus and more particularly, but not by way of limitation, to a planer type road construction apparatus affording precision planing of an existing paved roadway.

2. Description of the Prior Art

As was discussed in detail in U.S. Pat. No. 4,139,318, maintenance and repair of paved roadways by a planing process provides an economical and energy-conserving alternative to conventional repaving and resurfacing. The planing process, which involves cutting away a selected upper portion of the roadway, permits relative depth reduction of holes, bumps or recesses in the roadway by decreasing the overall thickness of the roadway. Thereafter, the roadway may be repaved to a specified thickness, thereby eliminating wasteful buildup of paving material on the roadway.

The planer apparatus described in U.S. Pat. No. 4,139,318 has provided a maneuverable, fast-moving and highly accurate improvement over prior art devices for accomplishing roadway planing operations. By virtue of the automatic elevation and cross-slope controls featured on the apparatus, the operator need not possess unusual skill or experience in order to plane a roadway surface to a predetermined grade and cross-slope. The dust control and reclaiming features of the apparatus described in the above-mentioned patent permit planing to be undertaken without generation of unrecovered atmospheric dust or pavement debris, thereby affording clean and waste-free planing operation.

While the apparatus described in the abovementioned patent has proven highly suitable for most planing applications, it lacks design features adapting it to use in certain difficult operational environments. For example, the design of the apparatus makes it difficult to achieve close side approaches to vertical obstructions such as walls and curbs. Close side approaches by such prior art apparatus are prevented by bulky chain drive assemblies for powering rotation of the cutter drum, which are normally mounted on either side of the apparatus.

During extremely cold weather conditions, prior art planers have experienced difficulty in achieving adequate dust control, which has been provided by water spray devices used in conjunction with planing cutters. During winter conditions dust control has been hampered by water freezing in the spray nozzles used to spray the dust generated during planing operations.

As with any type of powered machinery, there are occasions of power failure in a planer apparatus which require field or shop repair. In units the size of prior art planing cutters, including that described in U.S. Pat. No. 4,139,318, failure of the power drive unit during field operation results in an immediate immobilization of the apparatus. If this occurs, the apparatus can be moved only by towing, a difficult and time-consuming process. Should a power failure occur while the apparatus is located in a depressed cut in the roadway, it may be extremely difficult and impractical to tow the apparatus from the cut, in which case, the usual procedure is to repair or replace the power drive unit in the field.

During planing operations, it has been found that repair or replacement of the cutting teeth of the cutter drum is required during field operation of the planing apparatus. To achieve this repair or replacement, a cutting bit must be properly positioned so as to permit access by a field mechanic. It has been found that the cutting bit can be properly positioned only by turning the cutter drum by selectively actuating the main power drive unit to turn the cutting drum. Since this turning occurs at the same rapid rate of rotation as that of the cutter drum during planing operations, the cutter drum presents a potential personnel hazard during such repairs unless the main power unit is completely shut off and locked in this mode while personnel are working near the cutter drum. Once work has been completed on the cutting bits accessible in one setting of the cutter drum, the area must be vacated while the main drive unit is again actuated and the proper safety procedures are again invoked. This time consuming but necessary routine renders cutting bit repair or replacement a costly process.

Additionally, difficulties have been experienced with the reclaimer assemblies utilized in prior art planers of the type described in the above mentioned patent during actual operational conditions. Dirt and dust from the material carried by the reclaimer assembly tends to accumulate in and around conveyor rollers in the reclaimer assembly. Further, the conveyor motors of such prior art reclaimers have usually projected from the conveyor frame, making such motors vulnerable to collision damage by trucks positioned below the discharge end of the conveyor.

SUMMARY OF THE INVENTION

The present invention provides a planer apparatus for cutting a selected upper portion of a roadway surface comprising a main frame drivingly supported by a drive assembly, the main frame carrying a planing assembly comprising a rotating cutter drum assembly and a cutter drive assembly. The cutter drive assembly comprises a pair of cutter power assemblies disposed on one side of the main frame and connected to a rotating hub member. The rotating hub member is carried by a load-bearing hub support assembly, with the rotating hub member rotationally driving the cutter drum assembly.

The apparatus further comprises a reclaimer assembly for elevating and moving the roadway material disengaged from the roadway by the planer assembly. An upper material lifting conveyor of the reclaimer assembly features an upper conveyor cover connecting the side members of the upper conveyor frame, with the upper conveyor motor mounted on the upper conveyor frame between the side members. A conveyor water spray system cleans the non-transport surface of the conveyor belt of the upper material lifting conveyor.

The planer apparatus may be powered either by a main or an auxiliary drive unit, with the exhaust discharge system of the main drive unit disposed in heat-transferring relationship to a cutter water spray system providing dust control for the apparatus.

It is an object of the present invention to provide an apparatus for planing a paved roadway under difficult environmental conditions.

Another object of the present invention is to provide a planing apparatus capable of planing a roadway surface in close proximity to a vertical obstruction.

Another object of the present invention is to provide a planing apparatus in which dust generated by planing operations may be controlled even at low temperatures.

Another object of the present invention is to provide an alternative to the main drive unit of a planer apparatus in the event of failure of the main power drive unit or in the event that a low cutter drum rotational speed is required.

Another object of the present invention is to provide a reclaimer assembly for a planer apparatus in which the upper conveyor motor is protected during reclaiming operations, and in which conveyor rollers are not subject to accumulation of dust and debris associated with the operation of the reclaimer assembly.

Other objects and advantages of the invention will be evident from the following detailed description when read in conjunction with the accompanying drawings which illustrate the preferred embodiment of the invention.

BRIEF DESCRIPTION OF THE DRAWINGS

FIG. 6 is an enlarged view of a cutting bit support member, a plurality of which comprise the flighting sections of the cutter drum assembly shown in FIG. 5, shown on a portion of the cutter drum.

DESCRIPTION OF THE PREFERRED EMBODIMENT

Figure 1:
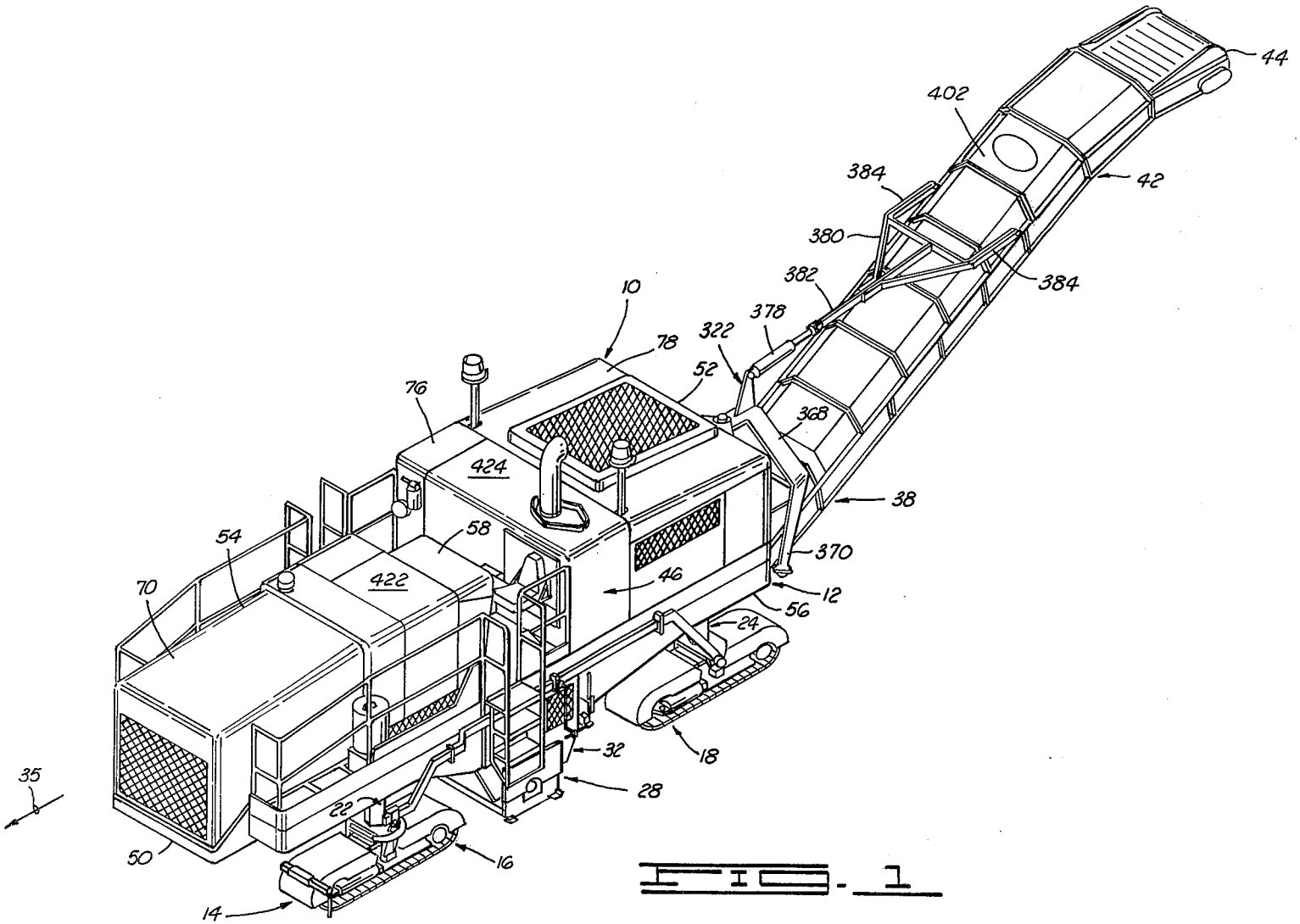
FIG. 1 shows a perspective view of the planing apparatus of the present invention.
Figure 2:
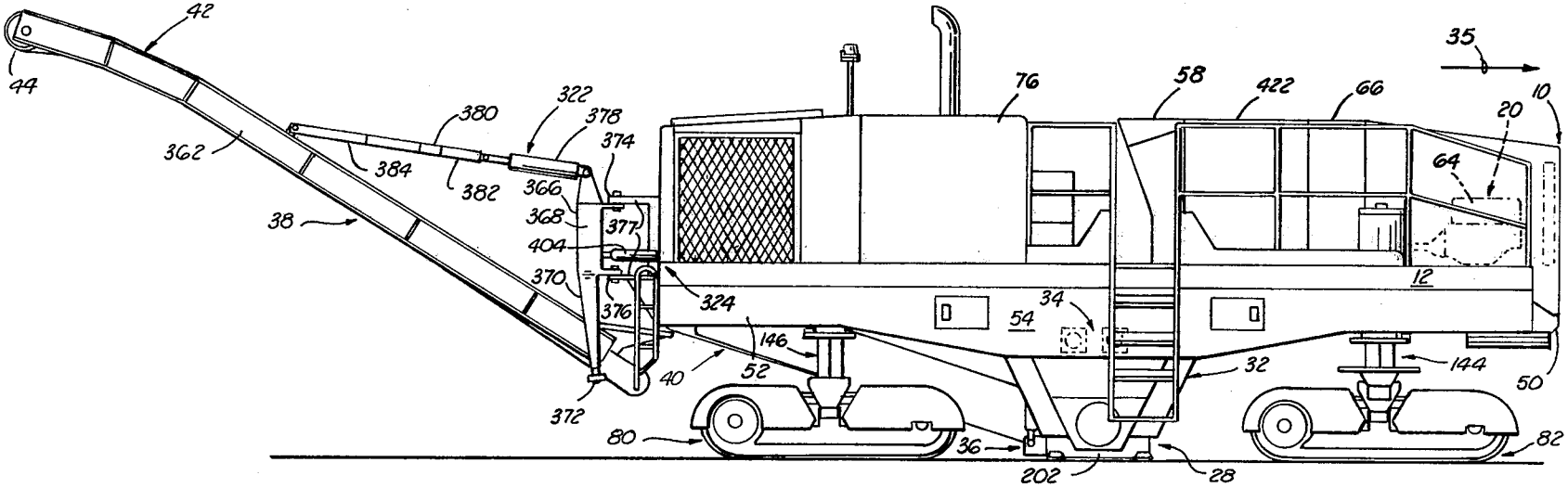
FIG. 2 is a side elevational view of the apparatus of FIG. 1, showing the right side.

By way of introduction and with reference to FIG. 1, the apparatus to be described in detail is generally designated by the reference numeral 10 and comprises a main frame 12 supported above a roadway surface by a drive assembly 14 comprising four track assemblies, of which a left forward track assembly 16 and a left rear track assembly 18 are shown in FIG. 1. The drive assembly 14 is powered for forward and rearward movement by a main drive unit 20 disposed on the main frame 12, as best shown in FIG. 2. Each track assembly is connected to the underside of the main frame 12 by a selectively extendable leg assembly of which a left forward leg assembly 22 and a left rear leg assembly 24 are shown in FIG. 1. Each leg assembly is responsive to an elevation control assembly 26 and a cross-slope control assembly (not shown) which maintain the main frame 12 in a selected spatial orientation in relation to the roadway surface. Steering of the apparatus 10 is accomplished by a steering assembly (not shown) engaged with the forward leg assemblies.

Figure 5:
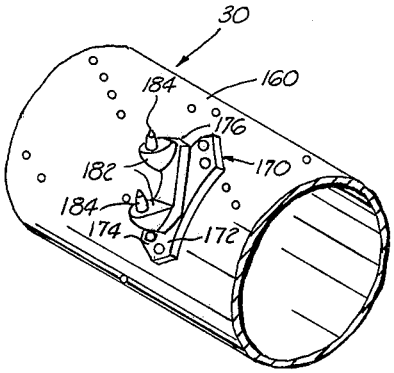
FIG. 5 is a semi-detailed, semi-diagrammatical, elevational representation of the cutter drum assembly and cutter housing assembly of the apparatus shown in FIG. 1, as viewed from the front of the cutter drum assembly. The door assembly and a portion of the housing frame have been omitted to provide a better view of the components.
Figure 3:
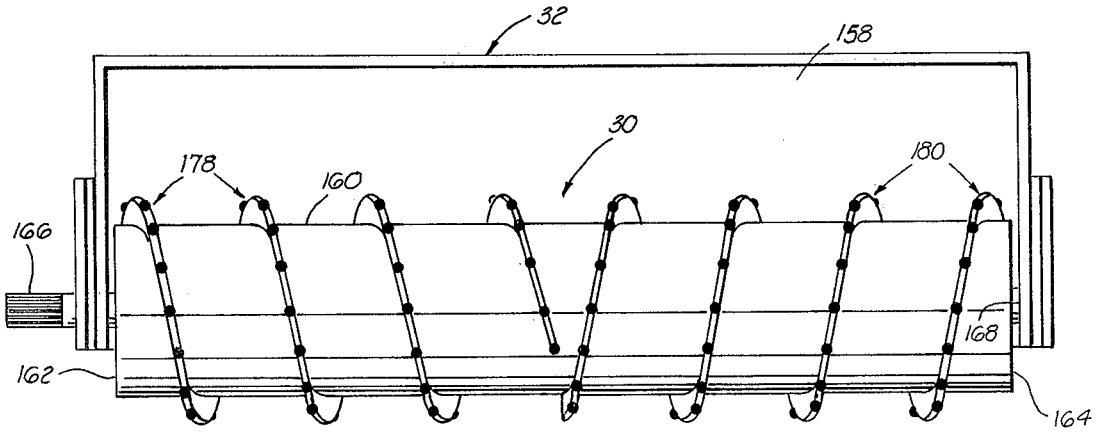

Supported beneath the main frame 12 is a planing assembly 28, comprising a rotatable cutter drum assembly 30, best shown in FIG. 5, and a cutter housing assembly 32 shown in FIG. 1. A cutter drive assembly 34 disposed on the right side of the main frame 12, as indicated in dashed lines in FIG. 2, powers rotational motion of the cutter drum assembly 30. The disposition of the cutter drive assembly 34 at one end of the cutter drum assembly 30 permits the other end of the cutter drum assembly 30 to be disposed in close proximity to the side of the main frame 12, thus permitting the planer apparatus 10 to be moved to within close proximity to curbs, vertical walls and the like as may required during planing operations.

As the planer apparatus 10 is moved in the forward direction 35 by the drive assembly 14, the cutter drum assembly 30 cuts pavement material from the roadway surface. By selective orientation of the main frame 12 via the elevation and cross-slope control assemblies, (described more fully in the above mentioned U.S. Pat. No. 4,139,138), the cutter drum assembly 30 may be oriented so as to cut the roadway surface to coincide with a reference plane of predetermined spatial orientation. Accordingly, a paved surface of preselected grade and cross-slope may be formed.

Pavement material dislodged from the roadway by the action of the cutter drum assembly 30 is retained and moved forward by a moldboard assembly 36, partially shown in FIG. 2. The pavement material is thereafter received through a central opening in the moldboard assembly 36 by a reclaimer assembly 38, which comprises lower material lifting conveyor 40, shown in FIG. 2, and an upper material lifting conveyor 42, shown in FIGS. 1 and 2. As will be discussed hereinbelow, the discharge end 44 of the upper material lifting conveyor 42 is movable in vertical and horizontal directions as required for convenient discharge of the roadway material into trucks.

Control of dust raised by the action of the planing assembly 28 is provided by a water spray system 46, which sprays water at points adjacent the planing assembly 28 and at points adjacent the conveyor belts of the lower and upper material lifting conveyors 40 and 42. Freezing of water within the water spray system 46 is prevented by routing the heated exhaust from the main drive unit 20 to those points susceptible to freezing.

Figure 3:
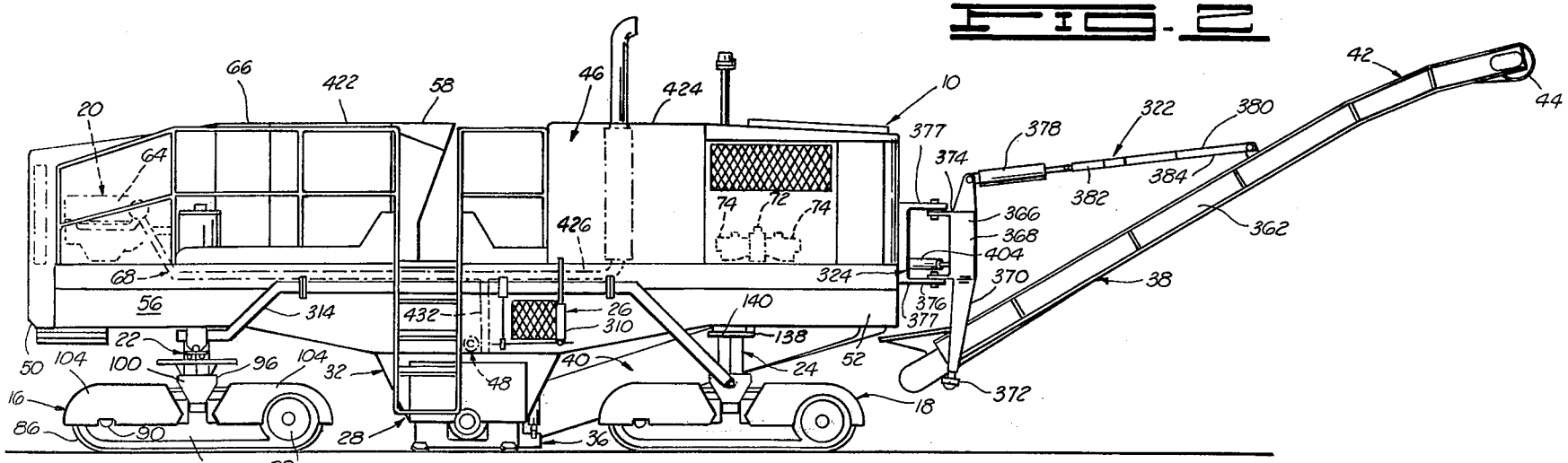
FIG. 3 is a side elevational view of the apparatus of FIG. 1, showing the left side.

An auxiliary drive unit 48, depicted in dashed lines in FIG. 3, is provided to permit selective elevation and movement of the main frame 12, and rotation of the cutter drum assembly 30, as may be required during emergency or maintenance operations when the main drive unit 20 cannot be used.

Turning now to a detailed description of the apparatus of the present invention and with reference to FIGS. 2 and 3, the main frame 12 of the apparatus 10 has a forward end 50, a rear end 52, a right side 54 and a left side 56. Centrally disposed on the main frame 12 is an operator console 58, at which an operator riding on the main frame 12 and facing its forward end 50 may remotely control operation of the components of the apparatus 10 in a manner to be described in greater detail hereafter.

The just-described component assemblies of the apparatus, including the drive assembly 14, leg assemblies, steering assembly, planing assembly 28 and reclaimer assembly 38, are powered by the main drive unit 20 which is disposed on the main frame 12. The main drive unit 20 comprises an engine 64, such as a diesel engine of conventional construction, mounted on the main frame 12 adjacent its forward end 50. The engine 64 is powered by hydrocarbon fuel, drawn via a fuel line (not shown) from a fuel tank 66 also disposed on the main frame 12, and may be actuated by a control at the operator console 58. Engine exhaust from the main drive unit 20 is routed into an exhaust discharge system 68, depicted by dashed lines in FIG. 3, which extends rearward beneath the main frame 12 via exhaust conduits to be described in greater detail hereafter.

The engine 64 is covered by a retractable forward cowling 70, shown in FIG. 1, which may be raised when servicing is required and which may be lowered during operation of the planing apparatus 10.

As shown in FIG. 3, the engine 64 powers, via conventional gear reducing gearboxes 72, a plurality of hydraulic pumps 74, disposed adjacent the rear end 52 of the main frame. These hydraulic pumps 74, which operate on hydraulic fluid drawn from a hydraulic fluid tank 76, shown in FIG. 1, are connected by conventional hydraulic conduits to the component assemblies of the planing apparatus 10. In a manner similar to the engine 64, the hydraulic pumps 74 and gearboxes 72 are covered by a retractable rear cowling 78, also shown in FIG. 1. The operation of the hydraulic pumps 74, as required for powering operation of the component assemblies of the apparatus 10, may be directed by controls at the operator console 58.

The drive assembly 14 comprises four track assemblies disposed beneath each of the four corners of the main frame 12. Each track assembly, which is connected to the main frame 12 by a leg assembly, functions to support and move the main frame 12. Since the left forward track assembly 16, left rear track assembly 18, right forward track assembly 82, and right rear track assembly 80 are all of substantially identical construction, only the left forward track assembly 16 will be described in detail.

With reference to FIG. 3, the left forward track assembly 16 comprises a horizontally oriented track frame 84 carrying an endless roadway-contacting chain track 86. The chain track 86 is engaged at one end of the track frame 84 with a rotatably mounted drive sprocket 88 and at the other end of the track frame 84 with a rotatably mounted return roller 90. A plurality of rollers (not shown) are engaged with the upper and lower portions of the endless chain track 86 along the length of the track frame 84, in order to provide further support for the endless chain track 86. The track is maintained in tight turning contact with the drive sprocket 88 and return roller 90 by a track tensioner (not shown) of conventional construction, disposed on either side of the track frame 84 so as to bias the return roller 90 in yielding engagement with the endless chain track 86.

The drive sprocket 88 is engaged, via a conventional gear reducing assembly (not shown), to the drive shaft of a hydraulic motor (not shown), which is connected by conduits (not shown) to a hydraulic pump 74 in the main drive unit 20. When the hydraulic motor is actuated, via a control at the operator console 58, the hydraulic motor drive shaft causes rotation of the drive sprocket 88, and thus causes forward motion by the endless chain track 86 which results in forward motion of the main frame 12 in the direction shown by the arrow 35.

A track speed indicator assembly (not shown), of conventional construction, is connected to the hydraulic motor in order to sense the motor speed, which is proportional to the track speed of the apparatus 10. An electrical circuit connects the track speed indicator assembly to the operator console 58 where the track speed may be displayed visually for operator reference. Since the track assemblies will be characterized by equal track speeds, only a single track speed indicator is required for the apparatus. Thus, while the track speed indicator discussed herein has been disposed at the left forward track assembly 16 for purposes of this application, it will be understood that the track speed indicator assembly may be alternatively disposed at any other one of the track assemblies.

Figure 4:
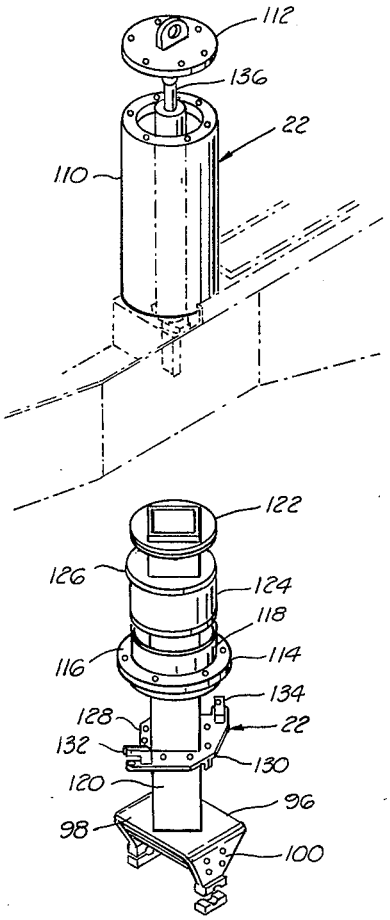
FIG. 4 is an exploded perspective view of the left forward leg assembly of the apparatus of FIG. 1.

The left forward track assembly 16 is connected to the main frame 12 via the left forward leg assembly 22. While the construction of the left forward leg assembly will be described in detail later in this application, it may be noted at this point that connection of the left forward track assembly 16 to the left forward leg assembly 22 is accomplished via a track yoke member 96 mounted on the upper portion of the track frame 84. As best seen in FIG. 4, the track yoke member 96 comprises a horizontal plate 98 and a pair of vertical plates 100 depending downwardly from opposite sides of the horizontal plate 98. As shown in FIGS. 2 and 3, the vertical plates 100 clear the endless chain track 86 and engage opposite ends of a cylindrical track axle member (not shown), which extends from one side of the track frame 84 to the other through a cylindrical opening in the track frame 84. The track frame 84 may pivot on track axle member as may be required to maintain the chain track 86 in contact with the roadway when an obstruction, or a crest of an undulation or the like, is encountered by the apparatus 10.

Front and rear fenders 104 are mounted on the upper portion of the track frame 84 on opposite sides of the track yoke member 96. Each fender is supported by brackets on the track frame 84 and functions as a safety guard for the chain track 86.

It will be noted that the provision of four track and leg assemblies represents an improvement over those prior art planers which have featured only three track and leg assemblies. The four track and leg assemblies permit wider distribution of the weight of the main frame 12, thereby stabilizing the apparatus 10. Further, the four track construction affords the use of a substantially rectangular main frame, which permits a better distribution of the components supported by the main frame 12, permitting the center of gravity of the apparatus 10 to more closely coincide with the position of the planing assembly 28 than in prior art planers. This permits maintenance and control of more uniform downward pressure on the planing assembly 28 by the main frame 12, as required for maximum control of vibrations, and for minimizing track assembly spinout and track wear by the apparatus 10.

As was mentioned previously, a leg assembly disposed adjacent each corner of the main frame 12 functions to connect each track assembly to the main frame 12. Each leg assembly further serves to maintain the main frame 12 at a selectively variable height above the roadway, as is required for proper cutting orientation of the planing assembly 28 to be described in greater detail hereafter. The leg assemblies are mounted on the left forward, left rear, right forward and right rear portions of the main frame 12 and, as the left leg assemblies are identical in construction to the right leg assemblies, only the left forward leg assembly 22 and left rear leg assembly 24 will be described in detail for purposes of this application.

As is best shown in FIG. 4, the left forward leg assembly 22 comprises a vertical outer cylinder 110 mounted on the main frame 12 at its left forward portion. The vertical outer cylinder 110 extends from its upper end, located above the main frame 12, to a lower end coinciding with the underside of the main frame 12. The vertical outer cylinder 110 is closed at its upper end by an end cap 112 which is secured by bolts (not shown) to the vertical outer cylinder, and is partially closed at its lower end by a lower closure member 114. The lower closure member 114 comprises a flange portion 116 bolted to the underside of the main frame 12, and an upward-extending cylindrical wall portion 118 closely received within the vertical outer cylinder 110, and extending a portion of the length thereof. It will be understood that the exploded view of the lower closure member 114 in FIG. 4, showing the lower closure member 114 disconnected from the main frame 12, is for viewing convenience only. When the apparatus 10 is in operation, the lower closure member 114 is at all times connected to the main frame 12.

A hollow tubular member 120 is coaxially received in the vertical outer cylinder 110 at its lower end. The tubular member 120 is rigid, and is characterized by a substantially square cross section along its axis. The lower end of the tubular member 120 is welded to the horizontal plate 98 of the track yoke member 96, previously described with reference to the left forward track assembly 16, while the upper end of the tubular member 120 is unsecured, and is thus permitted to move up and down within the vertical outer cylinder 110 as the tubular member 120 is drawn into or retracted therefrom. Again, it will be understood that the exploded view of FIG. 4 is for viewing convenience only, and that the upper end of the tubular member 120 is at all times within the vertical outer cylinder 110 during operation of the apparatus 10.

Adjacent its upper end, the tubular member 120 is received in a square-shaped central aperture of a circular guide member 122, which is welded to the tubular member 120. The guide member 122 is closely received within the vertical outer cylinder 110 and thus functions to position the tubular member 120 at the central portion of the vertical outer cylinder 110.

In order to steer the left forward track assembly of the apparatus 10, the tubular member 120 is caused to rotate about its own vertical axis relative to the vertical outer cylinder 110, thus causing turning movement by the track yoke member 96. Rotational motion of the tubular member 120 is accomplished via a vertical inner cylinder 124 having an upper end and a lower end, which is disposed adjacent the lower end of the vertical outer cylinder 110. The vertical inner cylinder 124 has a diameter slightly less than the wall portion 118 of the lower closure member 114 so that the lower end of the vertical inner cylinder 124 may extend into the lower end of the vertical outer cylinder 110. The vertical inner cylinder 124 carries at its upper end a rolling flange 126, which overlaps and engages the wall portion 118 of the lower closure member 114 so that the weight of the vertical inner cylinder 124 is carried by the lower closure member 114. The flange 126 is not shown in contact with the lower closure member 114 in the exploded view in FIG. 4, so that components of the leg assembly 22 may be displayed more easily.

With continued reference to FIG. 4, the vertical inner cylinder 124 features a passage portion, having a substantially square cross-section, which closely receives the tubular member 120 along its length. The vertical inner cylinder 124, positioned coaxially to the tubular member 120, terminates immediately below the lower closure member 114. Although not shown in the exploded view of FIG. 4. The lower end of the vertical inner cylinder 124 is engaged with a steering plate 128 via bolts (not shown9 which are secured to the bottom of the vertical inner cylinder 124. The steering plate 124 comprises a flange portion 130 which surrounds and clearingly receives the tubular member 120, a forward clevis 132 mounted on the upper side of the flange portion 130 and a rear clevis 134 disposed on the flange portion 130 on the opposite side of the tubular member 120 from the forward clevis 132. The forward and rear clevises are connected to the steering assembly in a manner to be described in greater detail hereafter. However it will be noted at this point that the steering assembly causes rotational motion of the steering plate 128 and thus the vertical inner cylinder 124. Because the passage portion of the vertical inner cylinder 124 closely receives the tubular member 120, rotational motion of the vertical inner cylinder 124 causes rotation of the tubular member 120, thus effecting turning of the track yoke member 96 and consequently turning of the left forward track assembly 16.

Extension and retraction of the left foward leg assembly 22, as may be required to alter the elevation and orientation of the planing assembly 28 with respect to the roadway surface, is accomplished by extension and retraction of a hydraulic cylinder 136 internally disposed within the tubular member 120. The hydraulic cylinder 136 is connected at its piston rod to the underside of the end cap 112, clearingly extends through the hollow interior of the tubular member 120 and is connected at its cylinder end, via a mounting lug (not shown), to the horizontal plate 98 of the track yoke member 96. The hydraulic cylinder 136 is connected via conduits (not shown) to a hydraulic pump 74 of the main drive unit 20. As the hydraulic cylinder 136 of the left forward leg assembly 22 is extended, the main frame 12 above the leg assembly 22 is raised, and the tubular member 120 is drawn from the vertical outer cylinder 110. As the hydraulic cylinder 136 is retracted, the main frame 12 is likewise lowered, and the tubular member 120 is retracted into the vertical outer cylinder 110. The extension and retraction operations just described may be directed via controls at the operator console 58.

It will be noted that steering of each track assembly, which is controlled by the orientation of the tubular member, is independent of the elevation of the main frame 12, which is controlled by the extension of the hydraulic cylinders. Accordingly, changes of the elevation of the main frame 12 of the planer apparatus 10 do not cause changes in travel direction, so that steering compensation by the operator is not required during operation of the planer apparatus 10.

The left rear leg assembly 24 is substantially identical to the left forward leg assembly 22 inasmuch as it is formed from a vertical outer cylinder closed by an end cap and a lower closure member, a vertical inner cylinder, a tubular member, a guide member and an internally disposed hydraulic cylinder, all arranged in the same manner as the components of the left forward leg assembly 22. The major difference between the left rear and the left forward leg assemblies rests in the replacement of the steering plate 128 of the left forward leg assembly 22 with an adjustment plate 138 in the left rear leg assembly 24. The adjustment plate 138, shown in FIG. 3, features a flange portion 140 engaged about the periphery of the tubular member 120 and secured by bolts to the bottom of the vertical inner cylinder 124 and the main frame 12 to maintain the adjustment plate 138, in a substantially fixed orientation. When the adjustment plate 138 is fixed in this manner, the vertical inner cylinder 124 and the tubular member 120 cannot rotate with respect to the vertical outer cylinder 110, so that the left rear track assembly 18 cannot be turned from its forward-facing orientation. The adjustment plate 138 thereby assures that apparatus movements are solely controlled and maintained by the steering assembly connected to the front track assemblies.

The right forward leg assembly 144, shown in FIG. 2, is identical in construction to the left forward leg assembly 22, and the right rear leg assembly 146 is identical in construction to the left rear leg assembly 24. Accordingly, these right forward and rear leg assemblies will not be described in further detail, other than to note that the right forward leg assembly 144 and right rear leg assembly 146 are disposed on the right forward and right rear portions of the main frame 12, respectively.

The steering assembly effects coordinated steering movement of the right and left forward track assemblies 16 and 82 in response to steering directions provided at the operator console 58. The steering assembly comprises first and second hydraulic cylinders (not shown) which motivate turning motion by the left and right forward track assemblies, and a tie rod (not shown) interconnecting the left and right forward leg assemblies 22 and 144 in order to assure that the left and right forward track assemblies 16 and 82 are turned in coordinated relationship. The first hydraulic cylinder is mounted at its cylinder end, via a clevis and pin (not shown) to a support bracket (not shown) depending from the underside of the main frame 12 approximately midway between the right side 54 and left side 56 of the main frame 12. The first hydraulic cylinder extends, in a direction substantially transverse to the main frame 12, to the steering plate 128 of the left forward leg assembly 22. The piston rod of the first hydraulic cylinder ends in a clevis, which is secured via a pin to the forward clevis 132 of the left forward leg assembly steering plate 128. In like manner, the second hydraulic cylinder is mounted at its cylinder end via a clevis and pin (not shown) to the same support bracket, and extends, transversely to the main frame 12 to the steering plate of the right forward leg assembly 144. The piston rod end of the second hydraulic cylinder ends in a clevis which is secured by a pin to the forward clevis of the right forward leg assembly steering plate. Both the first and second hydraulic cylinders are connected via conduits (not shown) to a hydraulic pump 74 of the main drive unit 20.

When the apparatus 10 is to be turned in the lefthand direction, the first hydraulic cylinder is extended and the second hydraulic cylinder is retracted, causing the steering plates of the left and right forward leg assemblies 22 and 144 to turn, thereby causing turning of the forward portions of the left and right forward track assemblies 16 and 82 toward the left. A tie bar (not shown) assures that the steering plates of the left and right forward leg assemblies move through equal turning angles so that the track assemblies are maintained in parallel position. In like manner, when the apparatus 10 is to be turned to its right, the second hydraulic cylinder is extended, and the first hydraulic cylinder is retracted, thereby causing simultaneous turning of the steering plates on the right and left forward leg assemblies 22 and 144. The turning of the steering plates causes parallel turning movement toward the right by the right and left forward track assemblies 16 and 18. The turning movements just described is actuated via conventional controls at the operator console 58.

The planing assembly 28 functions to plane the upper surface of a paved roadway to coincidence with a reference plane by cutting away a selected portion of the pavement material forming the roadway. Although similar in some respects to the planer assembly described in U.S. Pat. No. 4,139,318, assigned to the assignee of the present invention, the planing assembly 28 of the present invention will be described in some detail in order to assist in explanation of the operation of the apparatus 10. Referring to FIGS. 3, 5, 7 and 8, the planing assembly 28 comprises the cutter drum assembly 30, which is supported by the cutter housing assembly 32 and is powered by the cutter drive assembly 34 (shown in FIG. 9). A door assembly 156 and a moldboard assembly 36 are suspended, respectively, from the front and rear of the cutter housing assembly 32 to form, along with the cutter housing assembly 32, a material directing compartment 158 surrounding the cutter drum assembly 30. These component assemblies will now be discussed in greater detail.

As shown in FIG. 5, the cutter drum assembly 30 comprises a cylindrical cutter drum 160, having a first end 162 and a second end 164, disposed with its axis substantially transverse to the longitudinal axis of the main frame 12. The cutter drum 160 features an axial drive shaft 166 projecting from its first end 162 and an axial rotating shaft 168 projecting from its second end 164. These projecting shafts are rotatingly supported by the cutter housing assembly 32, to be described in greater detail hereafter, permitting the cutter drum 160 to rotate about its axis with respect to the cutter housing assembly 32.

A plurality of cutting bit support members 170 are connected to the curved surface of the cutter drum 160 via bolts. As shown in FIG. 6, each cutting bit support member 170 comprises a curved base portion 172 having an upper surface 174 and a lower surface (not shown), with the lower surface disposed in engaging contact with the surface of the cutter drum 160. Integral with the upper surface 174 of the cutting bit support member 170 is a flighting portion 176 comprising a relatively narrow elevated ridge extending transversely across substantially all of the base portion 172. The cutting bit support members 170 are secured in close proximity to one another around the surface of the cutter drum 160 so that the flighting portions 176 form a substantially continuous helical flighting elevated above the curved surface of the cutter drum 160, as shown in FIG. 5.

With continued reference to FIG. 5, the helical flighting formed by the contacting cutting bit support members 170 is characterized by a first flighting section 178 extending on the cutter drum 160 from its first end 162 to the central portion thereof, and by a second flighting section 180 extending on the cutter drum 160 from its second end 164 to the central portion of the cutter drum 160. The second flighting section 180 features a helical pitch equal and opposite to the helical pitch of the first flighting section 178. Thus, the drum may be rotated so that the first flighting section 178 appears to move from the first end 162 to the center, and the second flighting section 180 appears to move from the second end 164 to the center. This arrangement of the flighting into sections of opposite helical pitch permits the flighting on the rotating cutter drum 160 to direct loose roadway material, disposed on the roadway after being cut by the planing assembly 28, to an area beneath the central portion of the cutter drum 160. Here, as the apparatus 10 moves forward, the loose pavement material will be received by the reclaimer assembly 38, in a manner to be described in greater detail hereafter.

Disposed atop the flighting portion 176 of each cutting bit support member 170 are one or more bit holders 182, shown in FIG. 6. Generally, the cutting bit support members 170 disposed immediately adjacent the first and second ends of the cutter drum 160 will carry only a single bit holder 182, while other cutting bit support members 170 will carry two bit holders 182. Each bit holder 182 comprises an open-ended cylinder disposed such that its axis is substantially parallel to the planes defined by the ends of the cutter drum 160. At its point of intersection with the cutter drum 160, an imaginary line coincident with the axis of the bit holder 182 forms an acute angle with respect to an imaginary tangent to the cutter drum 160 passing through the point of intersection.

A cutting bit 184 is engaged in that end of each bit holder 182 remote from the flighting portion 176 of the cutting bit support member 170. The cutting bit 184, which is preferably formed from a hard, impact-resistant material such as tungsten carbide, features a projecting, relatively pointed tip portion which strikes the roadway as the cutter drum 160 is rotated, so as to cut away portions of a paved surface. The construction of a cutting bit and cutting bit support member such as that contemplated is described in detail in U.S. patent application Ser. No. 803,559, assigned to the assignee of the present invention, and consequently will not be further described herein.

The tips of the cutting bits 184 are positioned equidistantly from the rotational axis of the cutter drum 160, so that the cutting bits 184 define a single cutting plane as the cutter drum 160 is rotated. This cutting plane may be visualized by considering the deepest cuts made into the roadway by the rotating cutter drum 160 as the apparatus 10 moves along a planar roadway. Because the cutting bits 184 are equidistant from the cutter drum 160, the low points of these cuts will all lie in a single plane, which is referred to as the cutting plane of the cutter drum assembly 30.

Cutting bits 184, which will be worn down during operation of the cutter drum assembly 30, may be replaced by applying a striking pressure to the cutting bit 184, as by pneumatic hammer, through the open end of the bit holder 182 adjacent the flighting portion 176. It will likewise be noted that the individual cutting bit support members 170 may be replaced as required in the event that they become cracked or damaged during operation of the cutter drum assembly 30, via use of a pneumatic hammer to remove the bolts securing them to the cutter drum 160.

Figure 7:
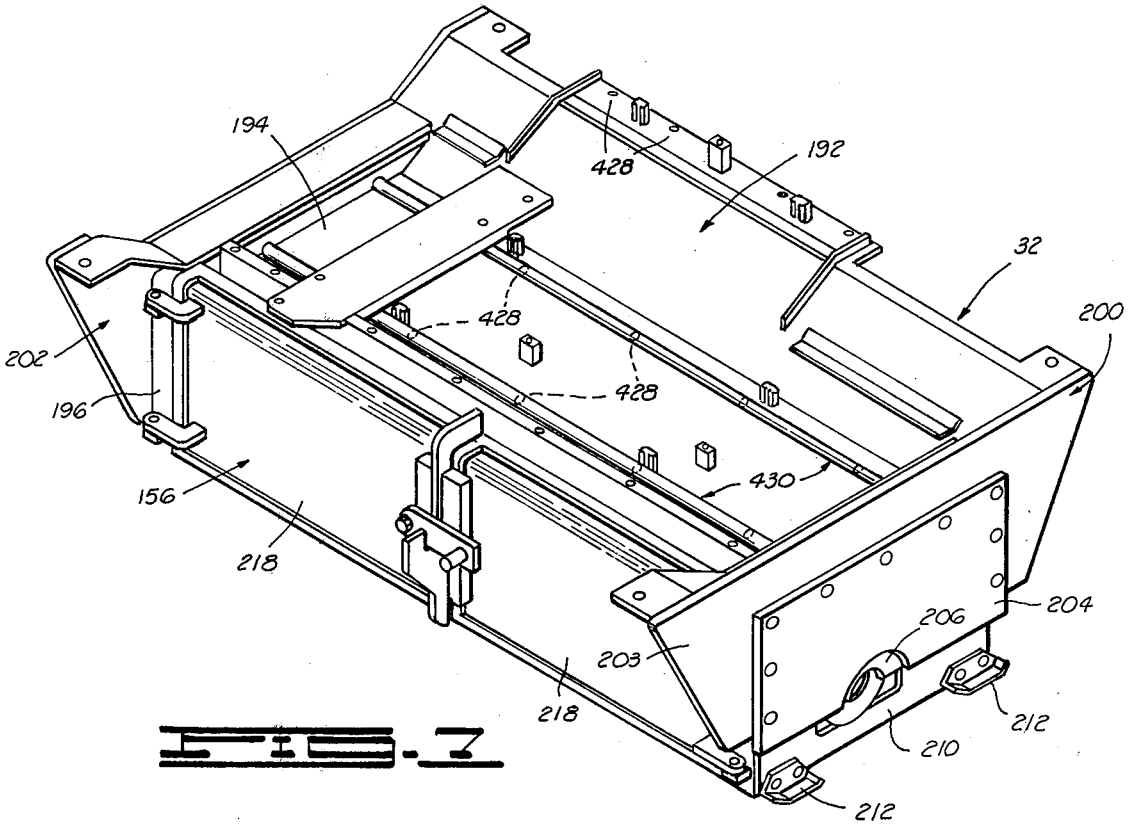
FIG. 7 is a perspective view of the cutter housing assembly and cutter door assembly of the apparatus of FIG. 1.

Further comprising the planing assembly 28 is the cutter housing assembly 32, which depends from the underside of the main frame 12 and which functions to support the cutter drum assembly 30 so as to maintain the axis of the cutter drum 160 in a fixed position relative to the main frame 12. The cutter housing assembly 32 is best shown in FIG. 7. The cutter housing assembly 32 comprises a housing frame 192 formed from an upper housing member 194 which is supported horizontally from the underside of the main frame 12. The upper housing member 194 is characterized by a rectangular shape in plan view, and is connected to a plurality of downward depending vertical frame members 196 depending from each corner of the upper housing member 194. The pair of vertical frame members 196 nearest the rear end 52 of the main frame 12 support a flat rear housing member 198, shown sectionally in FIG. 8. Adjacent pairs of the vertical frame members 196 on each side of the main frame 12 support a left side housing assembly 200 and a right side housing assembly 202, as shown in FIG. 7.

Figure 8:
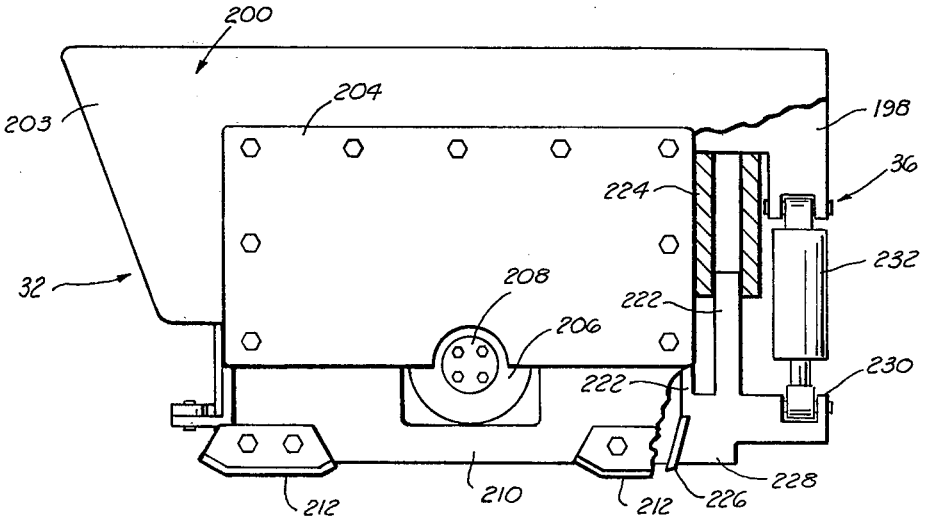
FIG. 8 is a partial side elevational view of the left side of the apparatus of FIG. 1, with the right side housing assembly partially cut away to show the moldboard assembly.

With continued reference to FIGS. 7 and 8, the left side housing assembly 200 comprises a centrally constricted left side housing member 203 which is connected to the pair of vertical frame members 196 nearest the left side 56 of the main frame 12. Bolted to the outer side of the left side housing member 203 is a left drum support plate 204, which functions to support the second end 164 of the cutter drum 160 at its rotating shaft 168, with the rotating shaft 168 extending beneath the left side housing member 203. Depending from the lower edge of the left drum support plate 204 is a recessed circular plate portion 206, having a circular aperture therein. A conventional roller bearing (not shown) is secured to the side of the left drum support plate 204 adjacent the cutter drum 160, so that the aperture in the bearing coincides with the aperture in the circular plate portion 206. The rotating shaft 168 of the cutter drum 160 is received in the coincident apertures of the bearing and left drum support plate 204, so as to permit rotation of the cutter drum 160 with respect to the cutter housing assembly 32. A circular retaining member 208 is disposed on the side of the circular plate portion 206 opposite the cutter drum 160 and is secured to the end of the rotating shaft 168 via bolts.

The left side housing assembly 200 further comprises a planar left sliding plate member 210 disposed between the left drum support plate 204 and retaining ribs (not shown) in the left side vertical frame members 196. The lower edge of the left sliding plate member 210 is disposed adjacent to the roadway surface so as to provide for substantially dust-tight side separation between the cutter drum 160 and the external environment. In order to maintain the lower edge in contact with the roadway surface as the planing assembly 28 is raised and lowered, so as to permit continuous dust control during the operation of the apparatus 10, the left sliding plate member 210 is permitted to slide vertically within a receiving cavity within the left side housing assembly 200. This receiving cavity is defined by the left side housing member 203, by the adjacent vertical frame members 196 and their retaining ribs on the left side 56 of the main frame 12, and by the left drum support plate 204. Thus, as the cutter drum 160 is raised, the left sliding plate member 210 is withdrawn from the cavity, and as the cutter drum 160 is lowered, the left sliding plate member 210 is retracted into the cavity. A vertically extending slot within the left sliding plate member 210 permits it to clear the cutter drum assembly 30 during such vertical sliding movements. A pair of ground shoes 212 depend downward from the lower edge of the left sliding plate member 210 on one side thereof, and constitute the ground-contacting portion of the left sliding plate member 210.

The right side housing assembly 202, partially shown in FIG. 2, comprises a right side housing member mounted on adjacent vertical frame members on the right side 54 of the main frame 12, and a right drum support plate mounted on the right side housing member. A right sliding plate member is disposed between the vertical frame members in the right drum support plate. The right side housing assembly is identical to the left side housing assembly in all respects, except that the drive shaft 166 of the cutter drum 160, rather than terminating in an aperture in the right drum support plate, instead extends through an aperture in the right drum support plate and engages the cutter drive assembly 34, to be described in greater detail hereafter. Because of the otherwise identical construction of the left and right side housing assemblies, the right side housing assembly 202 will not be described further for purposes of this disclosure.

The cutter housing assembly 32 is closed at its forward and rear ends by the door assembly 156 and by the moldboard assembly 36, respectively. As best shown in FIGS. 7 and 8, these assemblies function to establish, in cooperation with the cutter housing assembly 32, a material directing compartment 158 covering the forward, rear and overhead portions of the cutter drum assembly 30. Such a material directing compartment 158 serves to contain the dirt, debris and roadway material generated by the rotating cutter drum 160, and to reduce the noise associated with its cutting action. The construction of the door assembly 156 and moldboard assembly 36 will now be described in greater detail.

As shown in FIG. 7, the door assembly 156 comprises a pair of swinging door members 218 pivotally connected at opposite ends of the forward vertical frame members 196. These door members 218 may be selectively moved between an open position, in which each door member 218 extends toward the forward end 50 of the main frame 12, and a closed position, in which each door member 218 is secured to the forward portion of the cutter housing assembly 32, via a conventional latch mechanism as shown. The door members 218 are ordinarily closed when the apparatus 10 is in operation, for dust and noise control purposes. The door members 218 may be open, as required, when servicing operations are to be performed on the cutter drum 160 or on other components within the cutter housing assembly 32.

The moldboard assembly 36, shown in FIG. 8, is disposed rearward of the cutter drum 160, where it functions to confine and scoop up dislodged pavement material from the newly planed roadway surface prior to its reception by the reclaimer assembly 38. The moldboard assembly 36, which is substantially similar to the floating moldboard described in U.S. Pat. No. 4,139,318, assigned to the assignee of the present invention, comprises a longitudinal moldboard member 220 having a length approximately equal to that of the cutter drum 160, the moldboard member 220 being disposed behind and substantially parallel to the cutter drum 160. Attached to the moldboard member 220 and extending vertically upwards from either end thereof are a pair of vertical guide members 222, each having a rectangular cross-section. Only one of the vertical guide members 222 is shown in FIG. 8. Each vertical guide member 222 is in sliding engagement with a hollow tubular member 224, also of rectangular cross-section, which is supported beneath the upper housing member 194 of the cutter housing assembly 32. The tubular members 224 thus permit sliding movements by the moldboard member 220, while confining this movement to a direction substantially perpendicular to the plane of the main frame 12.

The moldboard assembly 36 further comprises a ground-contacting scoop member 226 which is connected to a downward projecting heel 228 on the moldboard member 220 and which functions to scoop up pavement material on the newly planed roadway surface. As the main frame 12 is raised and lowered during operation of the apparatus 10, as required for proper orientation of the cutter drum 160, the vertical guide members 222 of the moldboard member 220 can undergo sliding movement in the tubular members 224 so as to maintain the scoop member 226 in contact with the newly planed roadway surface.

Connected to either end of the moldboard member 220, near the right side 54 and left side 56 of the main frame 12, are a pair of clevis members 230, each of which is connected to the piston rod end of a vertically disposed hydraulic cylinder 232, one of which is shown in FIG. 8. The cylinder portion of each hydraulic cylinder 232 is connected by bolts to the rear frame member 198 mounted on the rear portion of the cutter housing assembly 32. The hydraulic cylinders 232 are connected in parallel via conduits (not shown) to a hydraulic pump 74 of the main drive unit 20, which maintains a constant downward pressure in each of the hydraulic cylinders 232. The pressure maintained by the hydraulic pump 74 on the hydraulic cylinders 232 is sufficient to downwardly bias the moldboard member 220 in contact with the newly planed roadway surface, but is not so large as to prevent the moldboard member 220 from moving upward in order to compensate for downward movements of the main frame 12. The hydraulic cylinders 232 thus maintain the blade member 226 of the moldboard member 220 in continuous contact with the roadway surface, as is required in order to retain pavement material dislodged by the cutter drum assembly 30 and in order to minimize dust and noise associated with operation of the apparatus 10.

The moldboard member 220 features a centrally disposed passage (not shown) through which debris and pavement material is passed to the reclaimer assembly 38. Appropriately shaped directing shields (not shown) may be attached to the moldboard member 220 to assist the flow of material into the reclaimer assembly 38. As will be discussed in greater detail with reference to the reclaimer assembly 38, the lower material lifting conveyor 40 is connected by hooks (not shown) to the moldboard member 220 at a point below the central passage, and is further supported via pivoting hinges to the main frame 12, which permits the lower material lifting conveyor 40 to follow the vertical movement of the moldboard member 220 during operation of the apparatus 10.

With reference to the foregoing description, the cooperative relationship between the cutter housing assembly 32, moldboard assembly 36 and door assembly 156, which collectively form the material directing compartment 158, and the cutter drum assembly 30, may be understood as follows. As the apparatus 10 moves forward, pavement material which is dislodged from the roadway by the action of the cutting bits 184 of the cutter drum assembly 30, is routed by the material directing compartment 158 to the moldboard assembly 36, which scrapingly carries the material along the roadway. The flighting sections 178 and 180 on the cutter drum 160 serve to move this pavement material to a position ahead of the central portion of the moldboard member 220, where the material is received by the reclaimer assembly 38.

Figure 9:
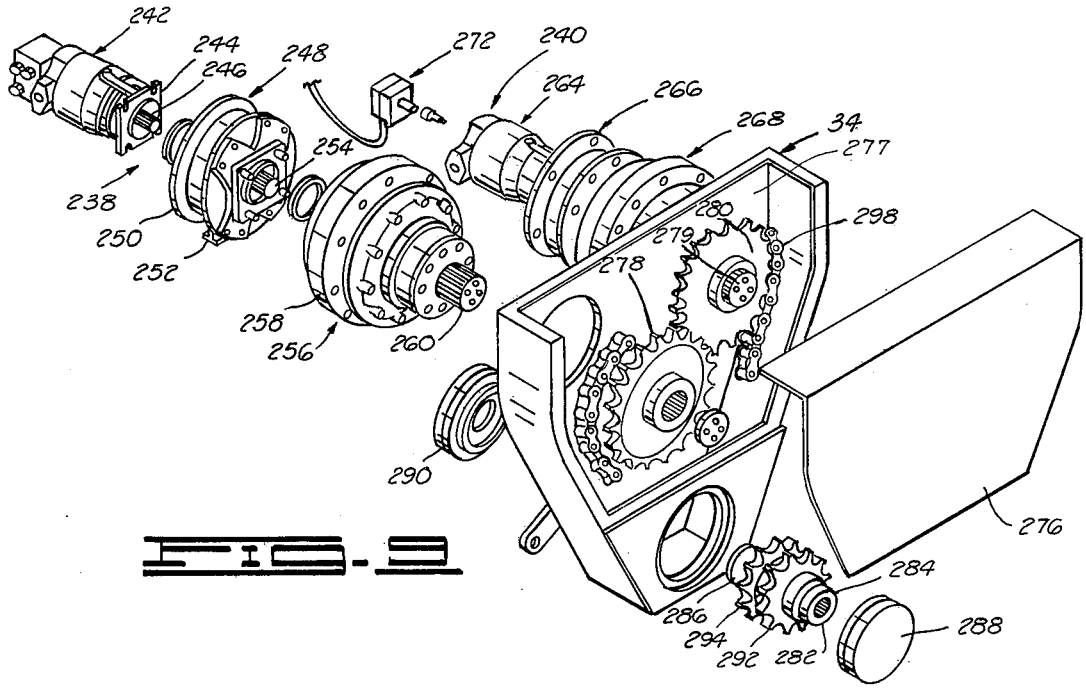
FIG. 9 is a partially exploded perspective view of the cutter drive assembly of the apparatus of FIG. 1, with the chain drive elements partially cut away to better display the components.

The cutter drive assembly 34, best shown in FIG. 9, powers rotational motion of the cutter drum assembly 30, and comprises a first cutter power assembly 238 and a second cutter power assembly 240 which are engaged in parallel with the drive shaft 166 of the cutter drum 160. For purposes of this disclosure, the cutter drive assembly 34 will be described as being disposed adjacent the right side 54 of the main frame 12, although it will be understood that the planing apparatus 10 could be constructed with the cutter drive assembly 34 disposed adjacent the left side 56 of the main frame 12, if desired.

The first cutter power assembly 238 comprises a first hydraulic motor 242, of the axial piston fixed displacement type, which is connected via hydraulic conduits (not shown) to a hydraulic pump 74 of the main drive unit 20 of the planing apparatus 10. As shown in FIG. 2 the first hydraulic motor 242 is disposed above the upper housing member 194 of the cutter housing assembly 32, adjacent the right side 54 of the main frame 12. Referring once again to FIG. 9, the first hydraulic motor 242 carries a flat mounting plate 244 at one of its ends, through which extends a horizontal, splined drive shaft 246.

Further comprising the first cutter power assembly 238 is a first flywheel assembly 248 having a housing portion 250, of substantially circular cross-section, and a base portion 252. The first flywheel assembly 248 is secured by bolts, at its base portion 252, to the upper housing member 194 of the cutter housing assembly 32. The first flywheel assembly 248 is further secured at one end of its housing portion 250, via bolts, to the mounting plate 244 of the first hydraulic motor 242. An appropriately sized bore in the first flywheel assembly 248 engages the drive shaft 246 of the first hydraulic motor 242. These connections are not shown in the exploded view of FIG. 9, in order to permit better component display.

The first flywheel assembly 248 is interposed in the drive train between the first hydraulic motor 242 and the cutter drum assembly 30 in order to reduce sharp pressure variations in the hydraulic conduits powering the first hydraulic motor 242. Such pressure variations can arise because of mechanical shocks generated as the cutting bits 184 of the cutter drum assembly 30 strike the roadway surface. Without the first flywheel assembly 248, these shocks could be transmitted through the drive train and to the hydraulic pump 74 of the main drive unit 20, which could thereby suffer severe mechanical damage. Provision of the first flywheel assembly 248 serves to reduce the magnitude and amplitude of the mechanical shocks which reach the main drive unit 20, thereby reducing the chances of its suffering damage.

The first flywheel assembly 248 features a torque limiter which prevents the transmission of large torques to the first hydraulic motor 242 in the event that rotation of the cutter drum assembly 30 is suddenly halted, as may occur when an exceptional load, such as a manhole, is encountered by the cutter drum assembly 30. The construction of a first flywheel assembly such as that contemplated, including the torque limiter feature, is described in detail in U.S. patent application Ser. No. 915,071, now U.S. Pat. No. 4,171,147, assigned to the assignee of the present invention, and need not be described further for purposes of this application.

With continued reference to FIG. 9, a splined horizontal output shaft 254 extends through an opening in the housing portion 250 of the first flywheel assembly 248, on the side of the housing portion 250 opposite the first hydraulic motor 242. This horizontal output shaft 254 in turn engages a first gear reduction assembly 256, at an appropriately sized bore formed therein. This connection is not shown in FIG. 9. The first gear reduction assembly 256 comprises a planetary gear reduction gearbox (not shown) of conventional construction which is disposed within a housing portion 258 of substantially circular cross-section. The housing portion 258 is secured, via bolts, to the housing portion 250 of the first flywheel assembly 248. On the side of the first gear reduction assembly 256 opposite the first flywheel assembly 248, a splined output shaft 260 extends through an appropriately sized opening in the housing portion 258.

The second cutter power assembly 240, identical in construction to the first cutter power assembly 238, comprise a second hydraulic motor 264, a second flywheel assembly 266, and a second gear reduction assembly 268, and is disposed atop the upper housing member 194 beside the first cutter power assembly 238, as shown in FIG. 2. The second cutter power assembly 240 is secured to the upper housing member 194 at the base portion (not shown) of its second flywheel assembly 266. Because the second cutter power assembly 240 is identical to the first cutter power assembly 238, its construction will not be further described.

As shown in FIG. 9, a cutter speed sensor assembly 272, of conventional construction, is connected to the second hydraulic motor 264 in order to measure its rotational speed, which is proportional to the rotational speed of the cutter drum 160. The connection is not shown in FIG. 9 in order to permit better display of the components. The cutter speed sensor assembly 272 is connected by conventional electrical conduits (not shown) to the operator console 58, where the motor speed is registered on a visual display. It will be understood that the cutter speed sensor assembly 272 could be connected to the first hydraulic motor 242, rather than to the second hydraulic motor 264, if desired.

Further comprising the cutter drive assembly 34 is a chain case 274 having a first side plate 276 (shown partially removed in FIG. 9) and a parallel second side plate 277, with the second side plate 277 secured to the right side housing assembly 202 via bolts. The first and second gear reduction assemblies 256 and 268 are secured at their housing portions to the second side plate 277 of the chain case 274 by bolts, and the respective output shafts of the gear reduction assemblies 256 and 268 extend into the upper portion of the chain case 274 through openings in the second side plate 277. Inside the chain case 274, the output shaft 260 of the first gear reduction assembly 256 axially engages a first upper sprocket 278, and the output shaft 279 of the second gear reduction assembly 268 axially engages a second upper sprocket 280. The two upper sprockets 278 and 280 are offset within the chain case 274 so as to be disposed in separate but parallel planes.

Disposed in the lower portion of the chain case 274 is a rotating hub member 282 having a first end 284 and a second end 286. The first end 284 of the rotating hub member 282 is rotatably mounted via a first bearing assembly 288, to the first side plate 276, and the second end 286 of the rotating hub member 282 is rotatably mounted, via a second bearing assembly 290, to the second side plate 277. The rotating hub member 282, and the bearing assemblies 288 and 290 are not shown inside the chain case 274 in FIG. 9 so as to permit better component display. The rotating hub member 282 features an integral first lower sprocket 292 and an integral second lower sprocket 294 which are coplanar with the first and second lower sprockets 278 and 280 respectively. A first endless chain loop 296 (shown partially cut away in FIG. 9) drivingly connects the first upper sprocket 278 with the first lower sprocket 292, and a second endless chain loop 298 (also partially cut away in FIG. 9) drivingly connects the second upper sprocket 280 with the second lower sprocket 294. The rotating hub member 282 is axially connected at its second end 286 with the drive shaft 166 of the cutter drum assembly 30, the drive shaft 166 extending into the chain case 274 through an opening in the second side plate 277. This connection is not shown in FIG. 9.

From the foregoing description it will be understood that the first and second hydraulic motors 242 and 264 function to drive the first and second upper sprockets 278 and 280 disposed within the chain case 274. The endless chain loops 296 and 298 within the chain case 274 transmit the motion of the first and second upper sprockets 278 and 280 to a single rotating hub member 282, which in turn engages the drive shaft 166 of the cutter drum assembly 30.

The just-described cutter drive assembly 34 incorporates two highly desirable improvements over prior art planers. First, the cutter drive assembly 34 is self-contained, and thus may be quickly and easily separated from the cutter drum assembly 30 by disengaging the rotating hub member 282 from the cutter drum drive shaft 166, as required for servicing of either the cutter drum assembly 30 or the cutter drive assembly 34. Prior art apparatus have generally featured a chain drive connection between the cutter drum and the cutter drive, rendering separation of these two elements of the planing assembly highly cumbersome.

The second improvement incorporated in the present cutter drive assembly 34 is the disposal of the entire drive assembly on one side of the cutter drum assembly 30. This feature permits the second end 164 of the cutter drum 160 to be disposed directly next to the side of the planer apparatus 10, permitting the planar apparatus 10 to be positioned more closely to vertical walls, curbs and other obstructions than has been possible with prior art apparatus. In such prior art machines, bulky drive assemblies have necessarily been disposed at both ends of the cutter drum, rendering such close side approaches by the apparatus impracticable.

From the foregoing description of the apparatus, it will be recognized that sufficient rotational power for the cutter drum 160 has been maintained by connecting the first end 162 of the cutter drum 160 to two separate cutter power assemblies 238 and 240. If these two cutter power assemblies were connected directly to the drive shaft 166 of the cutter drum 160, the bending moment applied to the drive shaft 166 by the tandem cutter power assemblies would be so great as to create a risk of damage to the cutter drum 160 during operation of the apparatus 10. Consequently, the cutter power assemblies 238 and 240 are instead connected to the rotating hub member 282, which is held within the chain case 274 by the first and second bearing assemblies 288 and 290. These bearing assemblies 288 and 290 and the chain case 274 accept the bending moment from the tandem cutter power assemblies, permitting the rotating hub member 282 to transmit an essentially pure torsional moment through the drive shaft 166 of the cutter drum 160, with which the rotating hub member 282 is axially engaged. This reduces the bending moment on the cutter drum assembly 30 and its drive shaft 166, thereby permitting the cutter drum assembly 30 to be disposed on one side of the main frame 12.

From the foregoing description, it will be understood that the cutter drum 160 is fixed with respect to the main frame 12. Consequently, the grade and cross-slope of a finished roadway, which are determined by the spatial orientation of the cutter drum 160 as the apparatus 10 moves forward, are ultimately controlled by the spatial orientation of the main frame 12. In the present apparatus, the attitude and elevation of the main frame 12 may be controlled automatically, so that the apparatus 10 may be programmed to produce a finished roadway surface having a specified grade and cross-slope as the apparatus 10 is driven forward.

Automatic control of the cross-slope of the finished roadway surface produced by the apparatus is provided by a cross-slope control assembly which comprises cross-slope sensor (not shown) which compares the cross-slope of the main frame 12 to the cross slope of a reference plane specified by the operator. The cross-slope control assembly thereafter directs extension and retraction of the hydraulic cylinders within the leg assemblies so as to maintain the right side 54 of the main frame 12 at this specified cross-slope with respect to the left side 56 of the main frame 12. Cross slope control assemblies of the type contemplated, are well known in the prior art and are described in U.S. Pat. No. 4,139,318 and the patents cited therein. Consequently, the design of the cross-slope control assembly will not be described in detail herein.

Automatic control of the elevation of the forward end 50 of the main frame 12 with respect to the rear end 52 of the main frame 12, which will in turn control the grade of the finished roadway surface, is provided by the elevation control assembly 26. Comprising the elevation control assembly 26 are elevation sensors which are disposed on the right side 54 and left side 56 of the main frame 12. The left side elevation sensor 310, shown in FIG. 3, responds to an elevation reference adjacent the left side 56 of the main frame 12, the elevation reference specifying the grade of a reference plane. The elevation control assembly 26 causes the hydraulic cylinders in the leg assemblies on the left side 56 of the main frame 12 to extend or retract as required for the cutter drum assembly 30 to make vertical movements following those of the elevation reference. In like manner, the right side elevation sensor (not shown) in FIG. 2, responds to an elevation reference adjacent the right side 54 of the main frame 12. The elevation control assembly 26 thereafter causes extension and retraction of the hydraulic cylinders on the right side 54. It will be understood that, if both right side and left side elevation sensors are used during operation of the apparatus 10, the cross-slope control assembly cannot be operated, since the cross-slope of the main frame 12 is determined at all points by the relative positions of the right and left elevation references.

Elevation control assemblies of the type contemplated are well known in the prior art, and are described in U.S. Pat. No. 4,139,318, and in the patents cited therein. Accordingly, the design and construction of the elevation control assembly will not be described for purposes of this application.

The elevation reference to be employed with the elevation control assembly 26 just described may be either a string line disposed along the roadway surface, or an averaging bar 314 mounted on either side of the apparatus 10, as seen in FIGS. 1 and 3. The averaging bar 314 acts in cooperation with the elevation control assembly 26 to maintain the elevation of the left side 56 of the main frame 12 at an elevation which is the average of the main frame elevation at its rear end 52, above the cut roadway, and the main frame elevation at its forward end 50, above the uncut roadway. Use of the averaging bar 314 as an elevation reference thus functions to leave a finished roadway in which discontinuities are reduced in magnitude, but are not entirely eliminated. It will be understood that an averaging bar may be used on the right side 54 of the main frame 12, if desired, or on both the right and left sides. Disposal of the averaging bar 314 on the left side 56 of the main frame 12 in this description is for purpose of example only. An averaging bar of the type contemplated is described in U.S. patent application Ser. No. 946,606, now U.S. Pat. No. 4,213,719, assigned to the assignee of the present invention.

An air compressor (not shown) disposed on the left side 56 of the main frame 12 is powered by fuel drawn from the fuel tank 66. The air compressor serves to power maintenance equipment, such as a pneumatic hammer, when repair or servicing of the cutter drum 160, or of related components, is required during field operation of the apparatus 10.

The air compressor additionally functions to power an auxiliary drive unit 48, which comprises a hydraulic pump of conventional construction disposed on the left side 56 of the main frame 12, as depicted in dashed lines in FIG. 3. The hydraulic pump powers the flow of hydraulic fluid from the hydraulic fluid tank 76, via conduits (not shown), alternatively to the operator console 58, or to the first hydraulic motor 242 of the cutter drive assembly 34. When the hydraulic pump directs hydraulic fluid to the operator console 58, fluid enters the system of conduits servicing the hydraulically controlled component assemblies of the apparatus 10, other than the cutter drive assembly 34, thereby permitting operation of these assemblies, subject to the controls provided at the operator control 58. When the hydraulic pump directs hydraulic fluid to the first hydraulic motor 242 of the cutter drive assembly 34, the cutter drum 160 is thereby caused to turn via the previously described action of the first cutter power assembly 238. Check valves (not shown) are disposed in the conduits connecting the auxiliary hydraulic pump to the cutter drive assembly 34 and to the operator console 58, so that operation of the main drive unit 20 does not cause hydraulic fluid to be pumped into the auxiliary drive unit 48.

The auxiliary drive unit 48 may be operated in instances when operation of the main drive unit 20 is either not possible or not advisable. For example, in the event of a failure in the main drive unit 20, the auxiliary drive unit 48 may be actuated to move the apparatus 10 out of a roadway cut, where it would otherwise be immobilized. Even if the main drive unit 20 is operational, the auxiliary drive unit 48 may be used during servicing operations, as for example when rotation of the cutter drum 160 is required for replacement of the cutting bits 184. Due to the smaller power output of the auxiliary drive unit 48, the cutter drum 160 may be rotated more slowly, so as to pose a lesser safety hazard to service personnel, than if the main drive unit 20 were to be used.

The reclaimer assembly 38, shown in FIGS. 1 and 2, comprises a lower material lifting conveyor 40 for receiving reclaimed roadway material from the planing assembly 28, and an upper material lifting conveyor 42 for receiving reclaimed roadway material from the lower material lifting conveyor 40 and discharging it into waiting trucks. In order to facilitate efficient loading of reclaimed material, the upper material lifting conveyor 42 may be selectively positioned, so that its discharge end 44 may quickly be moved to the location of a truck, thus avoiding the necessity for cumbersome maneuvering of trucks underneath the conveyor. Position control for the upper material lifting conveyor 42 is provided by a vertical conveyor positioning assembly 322 and a horizontal conveyor positioning assembly 324, both to be described in greater detail hereafter. The upper and lower material lifting conveyors 40 and 42 are similar in several respects to the material lifting conveyors described in U.S. Pat. Nos. 3,946,506 and 4,139,318, both assigned to the assignee of the present invention.

Figure 10:
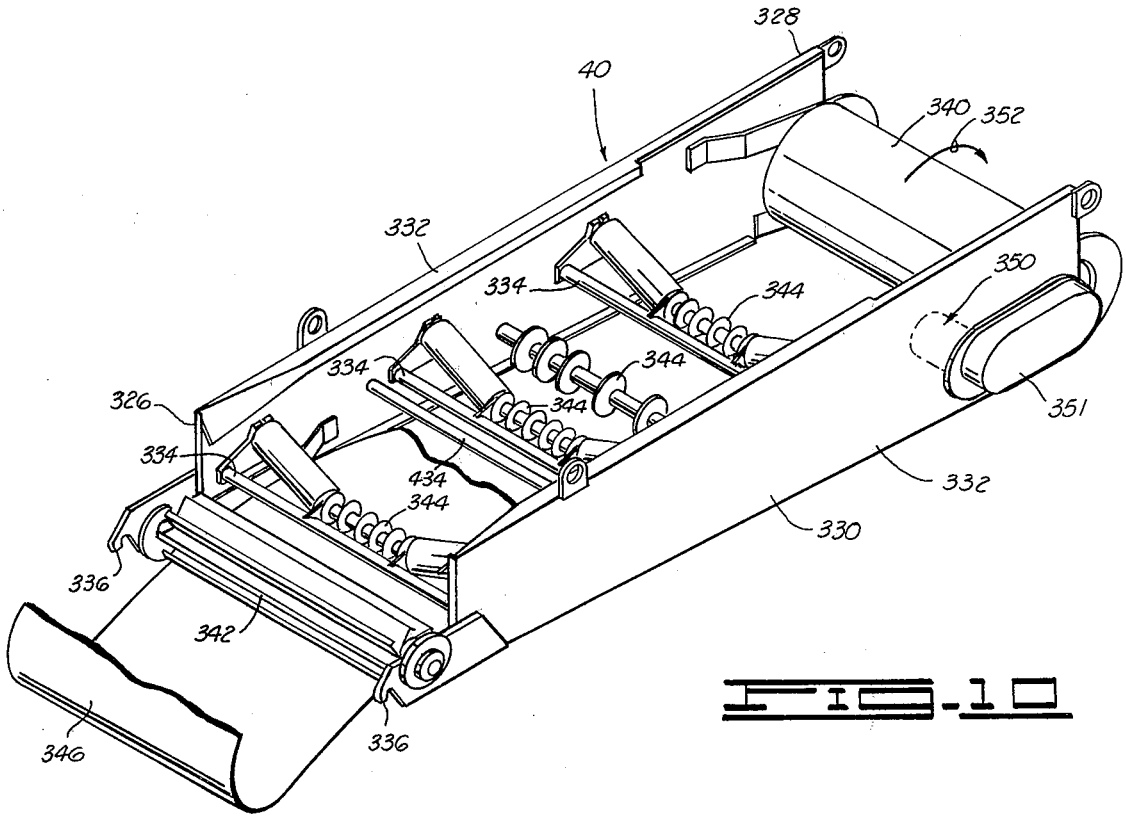
FIG. 10 is a perspective view of the lower material lifting conveyor of the apparatus of FIG. 1, with the conveyor cover and conveyor belt not shown in place to permit better display of the other components.

The lower material lifting conveyor 40, best shown in FIG. 10, is disposed adjacent to the underside of the main frame 12 and features a receiving end 326, disposed to receive material from the planing assembly 28, and a discharge end 328, with the discharge end 328 disposed at a height substantially higher above the roadway surface than the receiving end 326. The lower material lifting conveyor 40 comprises a lower conveyor frame 330, formed from two parallel side members 332 which are connected at selected locations along their length by a plurality of rigid cross members 334. At the receiving end 326, the side members 332 are secured, via projecting hooks 336, to the moldboard member 220 at the central opening therein so that roadway material may be received on the lower material lifting conveyor 40 from the planing assembly 28. The connection to the planing assembly 28 is not shown in FIG. 10. Adjacent its discharge end, the lower material lifting conveyor 40 is supported on either side by support members (not shown) connected to the lower side of the main frame 12.

The lower material lifting conveyor 40 further comprises an endless conveyor belt 338 (shown partially cut away in FIG. 10) rollingly engaged with a discharge end roller 340 and a receiving end roller 342. The discharge end roller 340 is supported by a shaft (not shown) connected at opposite ends to the side members 332 adjacent the discharge end 328 of the lower material lifting conveyor 40. In like manner, the receiving end roller 342 is supported by a shaft (not shown) connected to the side member 332 adjacent the receiving end 326. The discharge and receiving end rollers 340 and 342 function to divide the conveyor belt 338 into an upper or forward-travelling portion and a lower or rearward-travelling portion, with the upper portion of the conveyor belt 338 becoming the lower portion, and vice versa, as the conveyor belt 338 moves. The upper and lower portions of the conveyor belt 338 are firmly supported by a plurality of rollers 344 mounted along the length of the lower conveyor frame 330 and disposed substantially parallel to the discharge and receiving end rollers 340 and 342. The conveyor belt 338 is characterized by an outer or transport surface 346, on which roadway material is carried, and an inner or non-transport surface 348 which engages the receiving and discharge end rollers 340 and 342. It will be understood that the conveyor belt 338 has not been shown in engagement with the end rollers 340 and 342 in FIG. 10, in order to permit better component display.

A motor assembly 350 is provided between the two side members 332 of the lower conveyor frame 330 adjacent the discharge end 328, and comprises a hydraulic motor which is connected by conduits (not shown) to a hydraulic pump 74 of the main drive unit 20, with the hydraulic motor selectively operable by controls at the operator console 58. The hydraulic motor is covered by a housing cover 351. The drive shaft of the hydraulic motor is connected to a chain drive and gear box (not shown) engaged with the shaft carrying the discharge end roller 340 so that the motor assembly 350 may drive the discharge end roller 340 to rotate in the direction shown by the arrow 352, thereby causing the conveyor belt 338, with which the discharge end roller 340 is engaged, to move roadway material from the receiving end 326 to the discharge end 328 on the travelling upper portion of the conveyor belt 338.

A conveyor cover (not shown) is provided for the portion of the lower conveyor frame 330 adjacent the underside of the main frame 12, and is mounted to the lower conveyor frame 330 via conventional bolt connections to the side members 332. The conveyor cover functions to confine dust associated with roadway material carried on the upper portion of the conveyor belt 338 and further functions to contribute structural support to the lower material lifting conveyor 40. Further dust control is provided by flashing (not shown) connecting the lower material lifting conveyor 40 at its receiving end 326 to the moldboard assembly 36 and to the cutter housing assembly 32, so as to form a substantially dusttight connection between the planing assembly 28 and the lower material lifting conveyor 40.

Further comprising the reclaimer assembly 38 is the upper material lifting conveyor 42, best shown in FIG. 11, which features a receiving end 358, disposed below and adjacent to the discharge end 328 of the lower material lifting conveyor 40, and the discharge end 44. The discharge end 44 of the upper material lifting conveyor 42 is disposed at a height above the roadway which is substantially higher than the receiving end 358, so that trucks may conveniently receive roadway material dropped from the discharge end 44 of the upper material lifting conveyor 42. The upper material lifting conveyor 42 comprises an upper conveyor frame 360 formed from a pair of parallel side members 362 connected along their length by a plurality of rigid cross members 364. The upper conveyor frame 360 is supported from the rear end 52 of the main frame 12 by an upper conveyor support member 366. The upper conveyor support member 366, best shown in FIGS. 2 and 3, is characterized by a trunnion-type construction and features a body portion 368 from which extend a pair of parallel arms 370, each one of which is pivotally connected to a side member 362 of the upper material lifting conveyor 42 at a lug 372 projecting toward the roadway from the side member 362 (the lug 372 is not shown in FIG. 11). The upper conveyor support member 366 is connected to the main frame 12 at its body portion 368 by a horizontal upper lug 374 and a substantially parallel lower lug 376, both of which project from the body portion 368 and are pivotally engaged, via conventional mounting pins, with a pair of corresponding lugs 377 extending horizontally from the rear end 52 of the main frame 12.

Further support for the upper material lifting conveyor 42 is provided by the vertical conveyor positioning assembly 322, shown in FIGS. 1 and 2, which comprises a hydraulic cylinder 378 pivotally connected at its cylinder portion to the body portion 368 of the upper conveyor support member 366, and further connected at its piston rod portion to a conveyor positioning frame 380. The hydraulic cylinder 378 is connected by conventional conduits (not shown) to a hydraulic pump 74 of the main drive unit 20, and may be selectively extended or retracted via controls at the operator console 58. As best shown in FIG. 1, the conveyor positioning frame 380 features a central member 382 having a pair of diverging side arms 384 which are pivotally connected to lugs extending upwardly from the respective side members 362 of the upper conveyor frame 360, at a point intermediate to the discharge end 44 and the receiving end 358 of the upper material lifting conveyor 42. In order to protect against possible falling of the upper material lifting conveyor 42 in the event of failure of the hydraulic system or the hydraulic cylinder 378, a safety cable (not shown) may be provided to interconnect the conveyor positioning frame 380 and the body portion 368 of the upper conveyor support member 366.

Returning to FIG. 11, the upper material lifting conveyor 42 further comprises an endless conveyor belt 386 (shown partially cut away in FIG. 11) rollingly engaged with a discharge end roller 388 and a receiving end roller 390. The discharge end roller 388 is supported by a shaft (not shown) connected at opposite ends to the side members 362 adjacent to the discharge end 44 of the upper material lifting conveyor 42. In like manner, the receiving end roller 390 is supported by a shaft (not shown) connected to the side members 362 adjacent the receiving end 358. The discharge end roller 388 and receiving end roller 390 function to divide the conveyor belt 386 into an upper or forward-travelling portion and a lower or rearward-travelling portion, with the upper portion of the conveyor belt 386 becoming the lower portion, and vice versa, as the conveyor belt 386 moves. The upper and lower portions of the conveyor belt 386 are further supported by a plurality of rollers 391 which are mounted along the length of the upper conveyor frame 360 and which are disposed substantially parallel to the discharge and receiving end rollers 388 and 390. The conveyor belt 386 is characterized by an outer or transport surface 392, on which roadway material is carried, and an inner or nontransport surface 394 which contacts the discharge and receiving end rollers 388 and 390. It will be understood that the conveyor belt 386 has not been shown in engagement with the end rollers 388 and 390 in order to permit better component display.

A motor assembly 396 is provided between the two side members 362 of the upper conveyor frame 360 adjacent the discharge end 44, and comprises a hydraulic motor which is connected by conduits (not shown) to a hydraulic pump 74 of the main drive unit 20, with the hydraulic motor selectively operable by controls at the operator console 58. The hydraulic motor is covered by a housing cover 397. The drive shaft of the hydraulic motor is connected to a chain drive and gear box (not shown) engaged with the shaft of the discharge end roller 388 so that the hydraulic motor may drive the discharge end roller 388 to rotate in the direction shown by the arrow 398, thereby causing the conveyor belt 386 with which the discharge end roller 388 is engaged to move material from the receiving end 358 to the discharge end 44 on the travelling upper portion of the conveyor belt 386.

The positioning of the motor assembly 396 within the side members 362 of the upper conveyor frame 360, rather than outside the upper conveyor frame 360 as has been generally practiced in prior art conveyors, serves to reduce twisting of the upper conveyor frame 360 due to the weight of the motor assembly 396, since the motor assembly 396 is more centrally positioned with respect to the frame than in the prior art. Further, the motor assembly 396 is less subject to damage by collisions of the upper material lifting conveyor 92 with waiting trucks than is an exposed motor assembly, so that the upper material lifting conveyor 42 may be operated somewhat more flexibly than prior art conveyors.

Adjacent the receiving end 358 of the upper material lifting conveyor 42, a receiving hopper 400 is mounted on the upper portion of the upper conveyor frame 360 to receive roadway material from the discharge end 328 of the lower material lifting conveyor 40 and to direct the material onto the upper portion of the conveyor belt 386. Disposed on that part of the upper portion of the upper conveyor frame 360 not occupied by the receiving hopper 400 is a conveyor cover 402, shown in FIG. 1, which is mounted via conventional bolt connections to the side members 362 so as to cover substantially all of the upper portion of the conveyor belt 386 between the receiving hopper 400 and the discharge end 44. The conveyor cover 402 functions to control dust associated with roadway material carried on the upper portion of the conveyor belt 386. Additionally, the conveyor cover 402 adds to the structural strength of the upper conveyor frame 360, thereby permitting the use of lighter weight material in the construction of the side members 362. The conveyor cover 402 accordingly permits a lesser total weight for the upper material lifting conveyor 42 than would be possible with an uncovered conveyor frame 360, thereby contributing to economy of manufacture and operation of the apparatus 10.

As best shown in FIG. 2, the horizontal conveyor positioning assembly 324 serves to move the upper material lifting conveyor 42 from side to side such that the discharge end 44 follows a substantially horizontal arcuate path. Comprising the horizontal conveyor positioning assembly 324 is a hydraulic cylinder 404 pivotally connected at its cylinder end to the rear end 52 of the main frame 12 at one side thereof and pivotally connected at its piston rod end to a lug (not shown) extending from the upper conveyor support member 366. In the alternative, the piston rod may be connected to the lower lug 376. The hydraulic cylinder 404 is connected by conduits (not shown) to a hydraulic pump 74 of the main drive unit 20, and its extension and retraction may be directed via controls at the operator console 58. As the piston rod is extended and retracted, the upper conveyor support member 366 pivots at its upper and lower lugs 374 and 376 and thereby moves the upper material lifting conveyor 42 horizontally, as may be required for discharge of roadway material into a waiting truck.

In addition to providing support for the upper material lifting conveyor 42, the previously discussed vertical conveyor positioning assembly 322 also functions to control the elevation of the discharge end 44 of the upper material lifting conveyor 42. By extension and retraction of the hydraulic cylinder 378, the upper material lifting conveyor 42 may rotate about its connection point with the upper conveyor support member 366 at the lugs 372. This rotation causes raising and lowering of the discharge end 44 of the upper material lifting conveyor 42, as required for loading of discharging roadway material.

Figure 11:
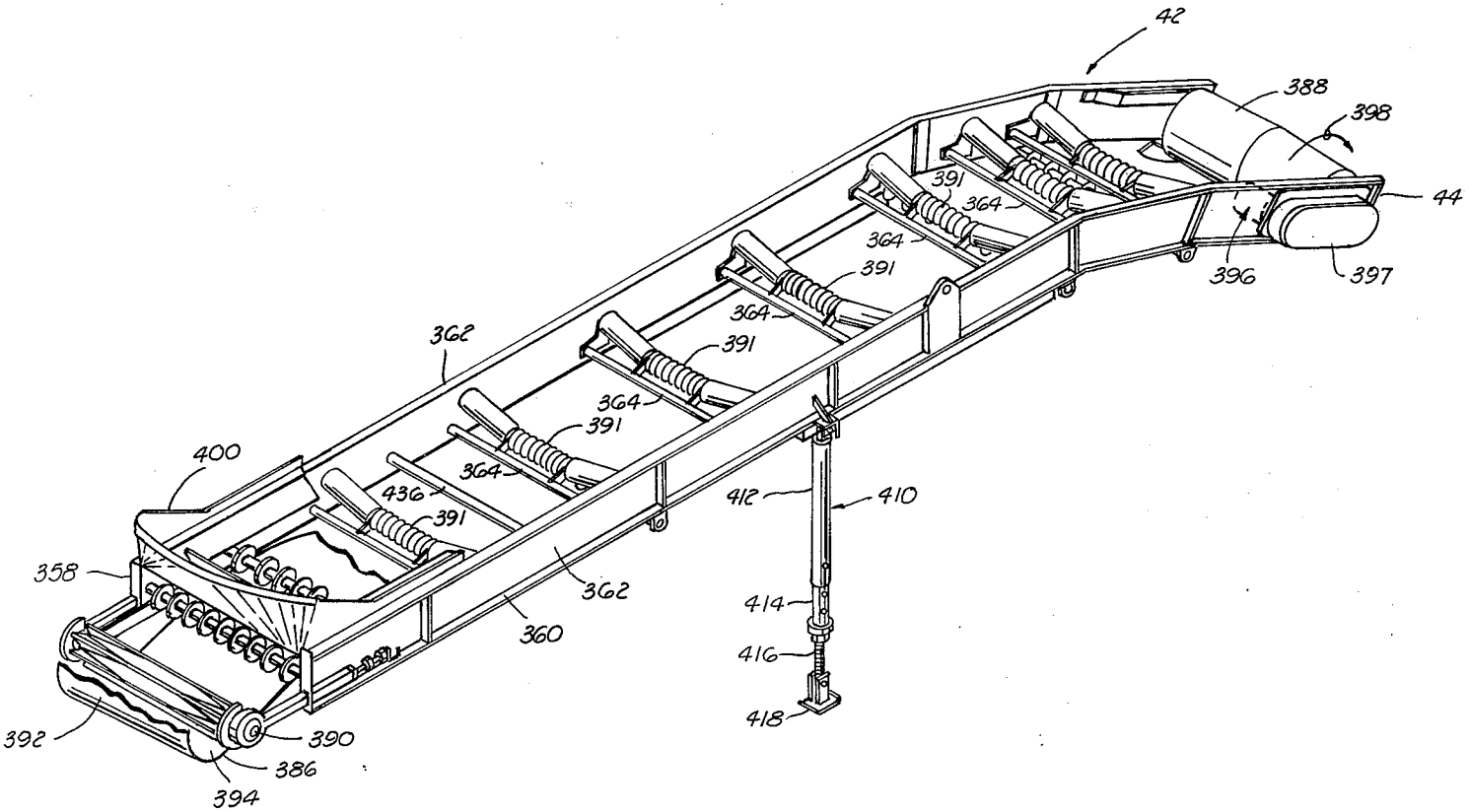
FIG. 11 is a perspective view of the upper material lifting conveyor of the apparatus of FIG. 1, with the conveyor cover and conveyor belt not shown in place to permit better display of the other components.

A shipping support assembly 410, shown in FIG. 11, is provided on each side member 362 of the upper conveyor frame 360 intermediate to the receiving end 358 and the discharge end 44 of the upper material lifting conveyor 42, for fixing the upper material lifting conveyor 42 with respect to a shipping surface during highway transport of the apparatus 10. Without such support, the upper material lifting conveyor 42 would bounce or jerk during transport, with possible resultant damage to the apparatus 10. Each shipping support assembly 410 comprises an outer cylinder 412, which is pivotally connected to the upper conveyor frame 360, and a telescoping inner cylinder 414 received in the end of the outer cylinder 412 opposite the upper conveyor frame 360. A threaded rod 416 is engaged in turn with the inner cylinder 414 at the end opposite the outer cylinder 412, and a ground shoe 418 is in turn engaged to the end of the rod 416 opposite the inner cylinder 414. Both the inner and outer cylinders 412 and 414 carry apertures passing through their respective diameters at locations spaced along their length. In order to support the upper material lifting conveyor 42 at a selected height above a shipping surface, the inner cylinder 414 is moved with respect to the outer cylinder 412 until the shipping support assembly 410 is extended to a length equal to the selected height. The outer and inner cylinders 412 and 414 are thereafter secured to one another via a pin passing through the aligned apertures in the two cylinders. The shipping support assembly 410 is then moved into a substantially vertical orientation and the upper material lifting conveyor 42 is thereafter lowered until the ground shoe 418 of the shipping support assembly contacts the shipping surface, so that the weight of the upper material lifting conveyor 42 is transferred to the shipping surface. During roadway operation of the apparatus 10, the shipping support assembly 410 is secured via brackets (not shown) alongside its corresponding side member 362 on the upper conveyor frame 360.

The water spray system 46 functions to provide the water required for control of dust generated by the apparatus 10 and for general cleanup of the apparatus 10 during field operations. Comprising the water spray system 46 are a forward water reservoir 422 and a rear water reservoir 424, disposed on the main frame 12 on opposite sides of the operator console 58, as shown in FIGS. 2 and 3. A variable pressure water pump (not shown) draws water from the water reservoirs 422 and 424 and directs it alternatively to cleanup hoses (not shown), or to the dust control spray bar assemblies disposed within the planing and reclaiming assemblies 28 and 38. The water pump is operated in a high pressure mode when water is to be supplied for machine cleanup, and is operated in a low pressure mode when water is to be supplied for dust control.

As shown in FIG. 3, a first exhaust conduit 426 of the exhaust discharge system 68 is routed to pass beneath, and in heat-exchanging contact with, the forward water reservoir 422, and is routed vertically through the interior portion of the rear water reservoir 424. By locating the first exhaust conduit in proximity to the water reservoirs 422 and 424, a large portion of the thermal energy of the exhaust fumes passing therethrough will be transmitted to the water in the water reservoirs during operation of the main drive unit 20. This heating serves to reduce the likelihood of freezing of components of the water spray system 46 during cold weather operation of the apparatus.

As shown in FIG. 7, the upper housing member 194 of the cutter housing assembly 32 is penetrated by a plurality of apertures 428, the apertures 428 being disposed along three imaginary lines from the right side 54 to the left side 56 of the main frame 12. Two of these lines are disposed adjacent the cutter drum assembly 30, at the forward and rear sides thereof. The third such line is disposed above the moldboard assembly 36, where roadway material is received by the reclaimer assembly 38. Disposed above each such line of apertures, as an additional element of the water spray system 46, is a spray bar assembly 430, comprising a closed header connected by conduits (not shown) to the water reservoirs 422 and 424. Another portion (not shown) of the spray bar assembly 430 is located above the moldboard assembly 36. Above each aperture 428 in the upper housing member 194, the spray bar assembly 430 carries a downward directed spray nozzle (not shown) for generating water spray from water furnished from the water reservoirs 422 and 424. Water spray from the spray nozzles serves to coalesce dirt and dust generated by the action of the planing assembly 28, thereby minimizing the dust levels associated with the operation of the apparatus 10. The cohesive action of the water droplets of the spray further functions to aggregate pavement material dislodged by the action of the cutter drum 160, so as to assist in the collection of this material for input into the reclaimer assembly 38.

The upper housing member 194 of the cutter housing assembly 32 is covered by an upper closure member (not shown) which forms a closed chamber containing the spray bar assemblies 430 disposed above the planing assembly 28. This chamber is connected, via an aperture in the upper closure member, to a second exhaust conduit 432, shown in FIG. 3 in dashed lines, the second exhaust conduit 432 connected to the exhaust discharge system 68 of the main drive unit 20. The connection of the second exhaust conduit 432 to the cutter housing assembly 32 is not shown in the Figures. Heated exhaust is discharged into the chamber during operation of the apparatus 10 and thereafter exist the chamber via the apertures 428 adjacent the spray nozzles. The heated exhaust fumes discharged into the chamber prevent water disposed within the spray nozzles, or within the conduit connected to the water reservoirs 422 and 424, from freezing during cold weather operation of the apparatus 10. Without provision of means to prevent freezing, a spray nozzle may freeze very rapidly, thereby cutting off flow of spray into the cutter housing assembly. Because of nozzle freezing, prior art planers have frequently been faced with serious dust control problems during winter weather.

With reference to FIG. 10, the water spray system 46 further comprises a spray bar assembly 434 mounted on the lower conveyor frame 330 between the upper and lower portions of the conveyor belt 338. The spray bar assembly 434 comprises a closed header mounted at opposite ends to the side members 332 of the lower conveyor frame 330. The header has a plurality of spray nozzles (not shown) along its length, the spray nozzles disposed to direct water spray onto the non-transport surface 348 of the conveyor belt 338. Water is supplied to the header from the water reservoirs 422 and 424 via conduits (not shown), the water flow to the spray bar assembly 434 controllable by the valves located at the operator console 58. Water sprayed onto the non-transport surface 348 of the conveyor belt 338 by the spray bar assembly 434 serves to wash dirt and dust from the conveyor belt 338 which would otherwise accumulate around the discharge and receiving end rollers 340 and 342 which contact the non-transport surface 348 of the conveyor belt 338.

With reference to FIG. 11, the water spray system 46 further comprises a spray bar assembly 436 mounted on the upper conveyor frame 360 between the upper and lower portions of the conveyor belt 386. The spray bar assembly 436 comprises a closed header mounted at opposite ends to the side memebers 362 of the upper conveyor frame 360. The header has a plurality of spray nozzles along its length, which spray nozzles are disposed to direct water spray onto the non-transport surface 394 of the conveyor belt 386. Water is supplied to the header via conduits (not shown) from the water reservoirs 422 and 424, water flow to the spray bar assembly 436 controllable by valve located at the operator console 58. As is the case with the conveyor belt 338, water sprayed onto the non-transport surface 394 of the conveyor belt 386 by the spray bar assembly 436 serves to wash dirt and dust from the conveyor belt 386 which would otherwise accumulate around the discharge and receiving end rollers 388 and 390.

Operation of the Preferred Embodiment

The operation of the planer apparatus 10 will be substantially evident from the foregoing description and from the description of planer operation provided in U.S. Pat. No. 4,139,318, assigned to the assignee of the present invention. Consequently, a detailed description of the operation of the apparatus 10 will be provided only with respect to those operational aspects not discussed in detail in U.S. Pat. No. 4,139,318.

As the planer apparatus 10 moves in a forward direction 35 along a roadway surface, the planing assembly 28 cuts away a preselected upper portion of the pavement material on the roadway surface, so that the surface coincides with the reference plane defined by the elevation and cross slope of the rigid main frame 12, as determind by the cross-slope and elevation controls such as the elevation control assembly 26. In order to accomplish this planing action, the cutter drum 160 is rotated within the cutter housing assembly 32 and engages the roadway surface via the cutting bits 184.

As best shown in FIG. 9, the cutter drum 160 is rotationally driven by the first and second cutter power assemblies 238 and 240, which are disposed on the right side 54 of the main frame 12. The respective cutter power assemblies 238 and 240 drivingly engage, via the output shafts of the first and second gear reduction assemblies 256 and 268, the first and second upper sprockets 278 and 280, which are disposed within the chain case 274. Rotational motion of the upper sprockets 278 and 280, driven by the cutter power assemblies 238 and 240, is transferred by the endless chain loops 296 and 298 to the rotating hub member 282. Rotation of the drive shaft 166 of the cutter drum 160 is in turn powered by the turning movement of the rotating hub member 282.

Because the rotating hub member is supported by the chain case 274 and the bearing assemblies 288 and 290, the bending moment applied to the rotating hub member 282 by the cutter power assemblies 238 and 240 is accepted by the chain case 274 rather than by the cutter drum 160. Consequently, a large torsional moment may be applied to the drive shaft 166, as required for powering planing action, without threatening damage to the cutter drum 160.

The pavement material cut from the roadway by the cutter drum 160 is moved forward along the roadway by the moldboard assembly 36 until it is received by the lower material lifting conveyor 40 and thereafter by the upper material lifting conveyor 42. It will be recalled that the upper material lifting conveyor 42 features greater flexibility of movement at its discharge end 42 than in prior art apparatus, as required for maximum ease of loading material into trucks, because the motor assembly 396 is disposed within the side members 362 of the upper conveyor frame 360. Here, the motor assembly 396 is protected from damaging contact with trucks, so that the positioning of the discharge end 44 does not require the degree of operator control needed in prior art machines.

During operation of the planar apparatus 10, the water spray system 46 provides water to the spray bar assemblies 430, disposed atop the planing assembly 28, which function to minimize atmospheric dust and dirt levels associated with the cutting action of the planing assembly 28. The water supply assembly 46 also provides water to the spray bar assemblies 434 and 436, which direct water spray to the non-transport surfaces 348 and 394 of the conveyor belts 338 and 386 of the lower and upper material lifting conveyors 40 and 42. By maintaining the non-transport surfaces 348 and 394 in clean condition, the spray bar assemblies 434 and 436 function to reduce mechanically damaging buildup of dust and dirt in and around the receiving end rollers 342 and 390 and the discharge end rollers 340 and 388.

During cold weather operation of the planer apparatus 10, the heated exhaust generated by the main drive unit 20 and discharged into the exhaust discharge system 68 functions to maintain the water within the water supply assembly 46 at a temperature above its freezing point. Exhaust discharged through the first exhaust conduit 426 heats water within the forward and rear water reservoirs 422 and 424, while exhaust discharged through the second exhaust conduit 432 heats the spray nozzles of the spray bar assemblies 430, in order to prevent their obstruction by icing.

The auxiliary drive unit 48 may be actuated, under power from the air compressor (not shown), in the event that operation of the planer apparatus 10 is required when it is either not possible or not advisable to actuate the main drive unit 20, such as when the planing assembly 28 is being serviced. In this event, the rotation of the cutter drum assembly 30 is powered by a direct hydraulic link between the auxiliary drive unit 48 and the first cutter power assembly 238. Operation of other component assemblies of the planer apparatus 10 is accomplished via a hydraulic link between the auxiliary drive unit 48 and the valve controls for these assemblies at the operator console 58. As an example, when there has been a power failure and the planar apparatus 10 is in a cut, the main frame 12 of the planing apparatus 10 can be elevated by power actuation of the leg assemblies 22, 24, 144 and 146, and if desired, the planer apparatus 10 can be moved over short distances under the power provided by the cooperative effects of the air compressor, the auxilliary drive unit 48 and the track assemblies 16, 18, 80 and 82.

It is clear that the present invention is well adapted to carry out the objects and attain the ends and advantages mentioned as well as those inherent therein. While a presently preferred embodiment of the invention has been described for purposes of this disclosure, numerous changes may be made which will readily suggest themselves to those skilled in the art and which are emcompassed within the spirit of the invention disclosed and as defined in the appended claims.

What is claimed is:

1. An improved planer apparatus for removing a top portion of a paved roadway to form a roadway surface having a predetermined grade and cross-slope, comprising:

a main frame;

drive means, disposed in contact with the roadway, for supporting and moving the main frame;

means for selectively varying the spatial orientation of the main frame with respect to the drive means; and planing means supported by the main frame for cutting the top portion of the roadway comprising:

rotatable cutter drum means having a first end and a second end and having an axis fixed with respect to the main frame, for cutting the top portion of the roadway; and cutter drive means for powering rotation of the cutter drum means, the cutter drive means comprising:

rotating hub means having a first end and a second end, with the first end engaged with the first end of the cutter drum means for driving rotation of the cutter drum means;

first cutter power means for driving rotation of the rotating hub means; and hub support means for supporting the rotating hub means and for bearing the bending load applied to the rotating hub means by the first cutter power means, the hub support means comprising:

a first hub support surface carried by the main frame, disposed in a plane normal to the rotational axis of the rotating hub means, adjacent the first end of the rotating hub means;

a second hub support surface carried by the main frame, disposed in a plane normal to the rotational axis of the rotating hub means, adjacent the second end of the rotating hub means; and bearing means mounted on the first and second hub support surfaces for rotatably engaging the rotating hub means at the first end and at the second end thereof.

2. The apparatus of claim 1 in which the rotating hub means is characterized as comprising a first lower sprocket and in which the first cutter power means is characterized as comprising:

a first upper sprocket; and a first endless chain engaged with the first upper sprocket and the first lower sprocket, for driving rotation of the rotating hub means.

3. The apparatus of claim 2 in which the first cutter power means further comprises:

first hydraulic motor means for driving rotation of the rotating hub means; and first flywheel means interposed between the first hydraulic motor means and the rotating hub means.

4. The apparatus of claim 3 in which the first cutter power means further comprises first gear reduction means interposed between the first hydraulic motor means and the rotating hub means.

5. The apparatus of claim 1 further comprising second cutter power means for driving rotation of the rotating hub means.

6. The apparatus of claim 5 in which the rotating hub means is characterized as further comprising a second lower sprocket and in which the second cutter power means is characterized as comprising:

a second upper sprocket; and a second endless chain engaged with the second upper sprocket and the second lower sprocket, for driving rotation of the rotating hub means, with the second endless chain disposed in a plane spaced in parallel relationship to the plane containing the first endless chain.

7. The apparatus of claim 6 in which the second cutter power means further comprises, in combination:

second hydraulic motor means for driving rotation of the rotating hub means; and second flywheel means interposed between the second hydraulic motor means and the rotating hub means.

8. The apparatus of claim 7 in which the second cutter power means further comprises second gear reduction means interposed between the second hydraulic motor means and the rotating hub means.

9. The apparatus of claim 1 further comprising:

an auxiliary drive unit for selectively powering operation of the planer apparatus.

10. The apparatus of claim 1 further comprising a first material lifting conveyor means for receiving roadway material dislodged by the planing means at a receiving end and for elevating and rearwardly moving the material to a discharge end, the first material lifting conveyor means further comprising, in combination:

a first conveyor frame formed from substantially parallel side members;

a receiving end roller rotatably mounted at opposite ends on the side members of the first conveyor frame adjacent the receiving end;

a discharge end roller rotatably mounted at opposite ends on the side members of the first conveyor frame adjacent the discharge end;

an endless conveyor belt having a transport surface for carrying roadway material and a non-transport surface engaged in rolling contact with the discharge and receiving end rollers, the rollers thereby dividing the conveyor belt into upper and lower portions; and a first conveyor motor mounted on the first conveyor frame between the side members and between the upper and lower portions of the conveyor belt, with the first conveyor motor driving rotation of the discharge end roller.

11. The apparatus of claim 10 in which the first conveyor frame further comprises a rigid first conveyor cover connecting the side members so as to extend over a selected one of the upper and lower portions of the conveyor belt.

12. The apparatus of claim 11 in which the first conveyor cover is mounted so as to overlay the upper portion of the conveyor belt.

13. The apparatus of claim 12 in which the first material lifting conveyor means further comprises a spray means mounted on the first conveyor frame for directing water spray onto the non-transport surface of the conveyor belt.

14. The apparatus of claim 10 further comprising:

second material lifting conveyor means, pivotally connected to the main frame, for receiving roadway material from the first material lifting conveyor means at a receiving end and for elevating and rearwardly moving the material to a selectively positionable discharge end, the second material lifting conveyor means further comprising:

a second conveyor frame formed from substantially parallel side members;

a receiving end roller rotatably mounted at opposite ends on the side members of the second conveyor frame adjacent the receiving end of the second conveyor frame;

a discharge end roller rotatably mounted at opposite ends on the side members of the second conveyor frame adjacent the discharge end of the second conveyor frame;

an endless conveyor belt having a transport surface for carrying roadway material and a non-transport surface engaged in rolling contact with the discharge end and receiving end rollers, the discharge and receiving end rollers thereby dividing the conveyor belt into upper and lower portions; and a second conveyor motor mounted on the second conveyor frame between the side members and between the upper and lower portions of the conveyor belt, with the second conveyor motor driving rotation of the discharge end roller.

15. The apparatus of claim 14 in which the second conveyor frame further comprises a rigid second conveyor cover connecting the side members so as to extend over a selected one of the upper and lower portions of the conveyor belt.

16. The apparatus of claim 15 in which the second conveyor cover is mounted so as to overlay the upper portion of the conveyor belt.

17. The apparatus of claim 16 in which the second material lifting conveyor means further comprises a spray means mounted on the second conveyor frame for directing water spray onto the non-transport surface of the conveyor belt.

18. The apparatus of claim 1 further comprising:

water spray means for dispersing water spray adjacent the cutter drum means; and a main drive unit for powering operation of the planer apparatus, the main drive unit further comprising:

an exhaust discharge system for routing exhaust produced by operation of the main drive unit to the external environment, with the exhaust discharge system permitting exhaust to pass in heat-transferring relationship to the water spray means.

19. The apparatus of claim 18 further comprising a cutter housing assembly, comprising:

an upper housing member disposed above the cutter drum, the upper housing member having a plurality of apertures formed therethrough adjacent the cutter drum means;

an upper closure member disposed above the upper housing member; and means coacting with the upper housing member and the upper closure member to form therewith a closed chamber above the planing means;

wherein the water spray means further comprises:

nozzle means disposed in said closed chamber for directing a spray mist of water through said apertures;

and wherein the exhaust discharge system further comprises:

an exhaust conduit terminating in said closed chamber, such that discharging exhaust from the exhaust conduit flows in heat-transferring contact with the nozzle means.

20. The apparatus of claim 19 in which the water spray means further comprises:

a storage tank for holding water to be transmitted to the nozzle means;

and in which the exhaust discharge system further comprises:

an exhaust conduit extending in heat-transferring contact with the storage tank.

21. An improved planer apparatus for removing a top portion of a paved roadway to form a roadway surface having a predetermined grade and cross-slope, comprising:

a main frame;

drive means, disposed in contact with the roadway, for supporting and moving the main frame;

means for selectively varying the spatial orientation of the main frame with respect to the drive means;

planing means supported by the main frame for cutting the top portion of the roadway; and a first material lifting conveyor means for receiving roadway material dislodged by the planing means at a receiving end and for elevating and rearwardly moving the material to a discharge end, the first material lifting conveyor means further comprising:

a first conveyor frame formed from substantially parallel side members;

a receiving end roller rotatably mounted at opposite ends on the side members of the first conveyor frame adjacent the receiving end;

a discharge end roller rotatably mounted at opposite ends on the side members of the first conveyor frame adjacent the discharge end;

an endless conveyor belt having a transport surface for carrying roadway material and a non-transport surface engaged in rolling contact with the discharge and receiving end rollers, the rollers thereby dividing the conveyor belt into upper and lower portions; and a first conveyor motor mounted on the first conveyor frame between the side members and between the upper and lower portions of the conveyor belt, with the first conveyor motor providing driving rotation of the discharge end roller.

22. The apparatus of claim 21 in which the first conveyor frame further comprises a rigid fist conveyor cover connecting the side members so as to extend over a selected one of the upper and lower portions of the conveyor belt.

23. The apparatus of claim 22 in which the first conveyor cover is mounted so as to overlay the upper portion of the conveyor belt.

24. The apparatus of claim 23 in which the first material lifting conveyor means further comprises a spray means mounted on the first conveyor frame for directing water spray onto the non-transport surface of the conveyor belt.

25. An improved planer apparatus for removing a top portion of a paved roadway to form a roadway surface having a predetermined grade and cross-slope, comprising:

a main frame;

drive means, disposed in contact with the roadway, for supporting and moving the main frame;

means for selectively varying the spartial orientation of the main frame with respect to the drive means;

planing means supported by the main frame for cutting the top portion of the roadway;

a first material lifting conveyor means for receiving roadway material dislodged by the planing means at a receiving end and for elevating and rearwardly moving the material to a discharge end; and a second material lifting conveyor means, pivotally connected to the main frame, for receiving roadway material from the first material lifting conveyor means at a receiving end and for elevating and rearwardly moving the material to a selectively positionable discharge end, the second material lifting conveyor means further comprising:

a second conveyor frame formed from substantially parallel side members;

a receiving end roller rotatably mounted at opposite ends on the side members of the second conveyor frame adjacent the receiving end of the second conveyor frame;

a discharge end roller rotatably mounted at opposite ends on the side members of the second conveyor frame adjacent the discharge end of the second conveyor frame;

an endless conveyor belt having a transport surface for carrying roadway material and a non-transport surface engaged in rolling contact with the discharge end and receiving end rollers, the discharge and receiving end rollers thereby dividing the conveyor belt into upper and lower portions; and a second conveyor motor mounted on the second conveyor frame between the side members and between the upper and lower portions of the conveyor belt, with the second conveyor motor providing driving rotation of the discharge end roller.

26. The apparatus of claim 21 or 25 in which the planing means is characterized as comprising:

rotatable cutter drum means having a first end and a second end and having an axis fixed with respect to the main frame, for cutting the top portion of the roadway; and cutter drive means for powering rotation of the cutter drum means, the cutter drive means comprising:

rotating hub means having a first end and a second end, with the first end engaged with the first end of the cutter drum means for driving rotation of the cutter drum means;

first cutter power means for driving rotation of the rotating hub means; and hub support means for supporting the rotating hub means and for bearing the bending load applied to the rotating hub means by the first cutter power means.

27. The apparatus of claim 26 in which the hub support means comprises:

a first hub support surface carried by the main frame, disposed in a plane normal to the rotational axis of the rotating hub means, adjacent the first end of the rotating hub means;

a second hub support surface carried by the main frame, disposed in a plane normal to the rotational axis of the rotating hub means, adjacent the second end of the rotating hub means; and bearing means mounted on the first and second hub support surfaces for rotatably engaging the rotating hub means at the first end and at the second end thereof.

28. The apparatus of claim 27 further comprising second cutter power means for driving rotation of the rotating hub means.

29. The apparatus of claim 25 in which the second conveyor frame further comprises a rigid second conveyor cover connecting the side members so as to extend over a selected one of the upper and lower portions of the conveyor belt.

30. The apparatus of claim 29 in which the second conveyor cover is mounted so as to overlay the upper portion of the conveyor belt.

31. The apparatus of claim 30 in which the second material lifting conveyor means further comprises a spray means mounted on the second conveyor frame for directing water spray onto the non-transport surface of the conveyor belt.

32. An improved planer apparatus for removing a top portion of a paved roadway to form a roadway surface having a predetermined grade and cross-slope, comprising:

a main frame;

drive means, disposed in contact with the roadway, for supporting and moving the main frame;

means for selectively varying the spatial orientation of the main frame with respect to the drive means;

planing means supported by the main frame for cutting the top portion of the roadway;

water spray means for dispersing water spray adjacent the planing means, the water spray means comprising at least one nozzle;

a cutter housing assembly enclosing the planing means and comprising:

an upper housing member disposed above the planing means, the upper housing member having at least one aperture formed therethrough adjacent said nozzle;

an upper closure member disposed above the upper housing member; and means coacting with the upper housing member and the upper closure member to form therewith a closed chamber above the planing means; and a main drive unit for powering operation of the planer apparatus, the main drive unit further comprising an exhaust discharge system for routing exhaust produced by the main drive unit to the external environment, with the exhaust discharge system further comprising:

an exhaust conduit terminating in said closed chamber, such that discharging exhaust from the exhaust conduit flows in heat-transferring contact with the nozzle.

33. In an apparatus for removing a top portion of a paved roadway, said apparatus having planing means for cutting away said top portion and conveyor means for transporting material dislodged from the roadway from the planing means, wherein said conveyor means comprises:

at least one conveyor frame formed from substantially parallel side members;

a plurality of rollers rotatably mounted on the side members and extending therebetween;

an endless conveyor belt mounted on the rollers, said belt having a transport surface along which the material dislodged from the roadway is transported and a non-transport surface engaged in rolling contact with said rollers; and means for rotationally driving one of said rollers, the improvement wherein said apparatus further comprises means, mounted on the conveyor frame, for directing water spray on to the non-transport surface of the conveyor belt.

* * * * *